US005754198A

United States Patent [19]

Nishikawa

[11] Patent Number: 5,754,198

[45] Date of Patent: May 19, 1998

[54] INK JET PRINTER

[75] Inventor: Masaji Nishikawa, Hachioji, Japan

[73] Assignee: Olympus Optical Co., Ltd., Tokyo, Japan

[21] Appl. No.: 565,778

[22] Filed: Dec. 1, 1995

[30] Foreign Application Priority Data

Dec. 6, 1994 [JP] Japan ..... 6-301952

[51] Int. Cl.[6] ..... B41J 2/21; B41J 2/145; B41J 2/15

[52] U.S. Cl. ..... 347/43; 347/40

[58] Field of Search ..... 347/9, 12, 13, 347/14, 43, 40

[56] References Cited

U.S. PATENT DOCUMENTS

| | | | |
|---|---|---|---|
| 4,528,576 | 7/1985 | Koumura et al. . | |
| 4,812,859 | 3/1989 | Chan et al. . | |
| 5,359,355 | 10/1994 | Nagoshi et al. | 347/41 |

FOREIGN PATENT DOCUMENTS

| | | |
|---|---|---|
| 0 595 658 A2 | 5/1994 | European Pat. Off. . |
| 60-120066 | 6/1985 | Japan . |
| 1-110965 | 4/1989 | Japan . |
| 3-76224 | 12/1991 | Japan . |
| 6-135007 | 5/1994 | Japan . |

*Primary Examiner*—Benjamin R. Fuller
*Assistant Examiner*—Thinh Nguyen
*Attorney, Agent, or Firm*—Frishauf, Holtz, Goodman, Langer & Chick

[57] ABSTRACT

An ink jet printer comprises a plurality of multi-nozzle array ink jet print heads arranged in a sub-scanning direction in which recording paper is sent. The ink jet print heads are arranged for scanning forward and backward in a main scanning direction to record different color ink onto the recording paper, and each of the ink jet print heads has a nozzle unit including a plurality of nozzle portions. The plurality of nozzle portions are arranged to jet a predetermined ink to the recording paper sent in the sub-scanning direction every time the forward scanning and the backward scanning are performed so as to form a stripped scanning printed area on the recording paper corresponding to a scanning width in the sub-scanning direction of each of the nozzle units of the ink jet print heads. The ink jet print heads are structured to satisfy $W<P<2W$, where P is an array pitch of the ink jet print heads, and W is the scanning width in the sub-scanning direction of each of the nozzle units of the ink jet print heads. In addition, the array pitch P substantially satisfies $W(1+(1/N'))$, where N' corresponds to one of (i) a number of heads of basic color ink and (ii) a number of heads of all colors.

7 Claims, 11 Drawing Sheets

INK JET PRINTER

BACKGROUND OF THE INVENTION

1. Field of the Invention

The present invention relates to an ink jet printer for providing a desired color printing onto a recording paper.

2. Description of the Related Art

Conventionally, in this type of ink jet printer, there are provided N number of multi-nozzle ink jet print heads, which correspond to N number of color inks and which can scan back and forth in a main scanning direction. In this case, a plurality of nozzle portions arranged in a sub-scanning direction, which is a recording paper feeding direction, are provided in the multi-nozzle ink jet print heads, respectively.

In such an ink jet printer, predetermined ink is jetted to form a band-like scanning print area at the time of scanning forward and backward, and recording paper is moved in the sub-scanning direction in accordance with the respective main scanning. Thereby, a desired color printing is achieved on the recording paper.

Normally, N number of multi-nozzle ink jet print heads are sequentially arranged to be adjacent to each other along the main scanning direction and to be placed at the same position along the sub-scanning direction.

Under the above-mentioned arrangement, when ink is jetted at the time of scanning forward and backward, there often occurs a case in which the order of the color superimposition at the time of the forward scanning is different from that of the color superimposition at the time of the backward scanning.

For example, Japanese Patent Application KOKOKU Publication No. 3-76224 (hereinafter called as prior art 1) discloses the following image recording apparatus.

More specifically, as shown in FIG. 15A, the above image recording apparatus of prior art 1 comprises first to fourth multi-nozzle ink jet print heads 2Y, 2M, 2C, 2BK, a carriage 6, and a pulse motor 10.

The multi-nozzle ink jet print heads 2Y, 2M, 2C, 2BK are arranged in a sub-scanning direction to be adjacent to each other. The carriage 6 can be moved back and forth along a pair of guide rails 4 provided in main scanning directions (arrows R and L in the figure) in a state that the first to fourth multi-nozzle ink jet print heads 2Y, 2M, 2C, 2BK are mounted on the carriage 6. The pulse motor 10 moves the carriage 6 back and forth in the main scanning directions (R, L) through a timing belt 8.

According to the above-mentioned structure, a recording paper 12 faces the first to fourth multi-nozzle ink jet print heads 2Y, 2M, 2C, 2BK in order without depending on the forward and backward movement of the multi-nozzle ink jet print heads 2Y, 2M, 2C, 2BK in the main scanning directions (R, L), and the recording paper 12 is step-fed by a unit of a sub-scanning width in the sub-scanning direction Y every main scanning. As a result, there does not occur the problem in which the above-mentioned difference in the order of color superimposition is generated. Due to this, a stripped pattern due to color nonuniformity of the unit of sub-scanning width can be prevented from being generated.

Moreover, in the case of using N number of normal multi-nozzle ink jet print heads, there often occurs a case in which dot-pitch stripped patterns are generated on a stripped scanning boundary of each color formed on the recording paper when each ink is jetted onto the recording paper at the time of scanning forward and backward. Such dot-pitch stripped patterns can be reduced to some extent by improving sub-scanning accuracy. However, it is extremely difficult to prevent the generation of the dot-pitch stripped patterns with high accuracy by a low cost mechanism. Particularly, in the apparatus of prior art 1, since the stripped scanning areas of the respective colors are superimposed on each other at the same position, the generation of the strips, which are caused by the dot-pitch stripped patterns, that is, the stripped patterns, are further emphasized.

To solve the above problem, for example, Japanese Patent Application KOKOKU Publication No. 60-120066 (hereinafter called as prior art 2) discloses the following charge-controlling typed color ink jet printer.

More specifically, as shown in FIG. 15B, the above color ink jet printer of prior art 2 comprises a carriage 6 on which first to fourth multi-nozzle ink jet print heads 2Y, 2M, 2C, 2BK, which are shifted in the sub-scanning direction Y, are mounted. Then, the carriage 6 is moved back and forth along a pair of guide rails 4 in main scanning directions (R and L), so that band-like scanning, which is the same as in prior art 1, can be performed.

According to the above-mentioned structure, since the band-like scanning boundaries of the respective colors are shifted to positions which are different from each other, the above-mentioned stripped patterns can be prevented from being emphasized.

However, in the apparatus of prior art 1, the generation of the stripped patterns, which are caused by the change of the order of the color superimposition, can be prevented. However, there is a problem in which the generation of the stripped patterns, which are emphasized when the stripped scanning boundaries of the respective colors are superimposed on each other, cannot be prevented.

In the apparatus of prior art 2, the generation of the striped patterns, which are emphasized when the stripped scanning boundaries of the respective colors are superimposed on each other, can be prevented. However, there is a problem in which the generation of the stripped patterns, which are caused by the change of the order of the color superimposition, cannot be prevented.

SUMMARY OF THE INVENTION

The present invention has been made to solve the above-mentioned problems, and an object of the present invention is to provide an ink jet printer in which generation of stripped patterns, which are caused by a change of the order of a color superimposition at the time of forward and backward scanning, can be prevented, and in which generation of stripped patterns, which are emphasized when stripped scanning boundaries of the respective colors are superimposed on each other, can also be prevented.

Moreover, another object is to provide an ink jet printer in which an array of dot pitches of stripped scanning boundaries of respective colors, which are formed at the time of forward and backward scanning, can be prevented from being shifted.

The present invention has the following structure and advantages.

(1) The ink jet printer of the present invention comprises a plurality of multi-nozzle array ink jet print heads arranged in a sub-scanning direction where recording paper is sent, and capable of scanning forward and backward in a main scanning direction to record different color ink onto the recording paper; and a plurality of nozzle portions provided to each of the plurality of multi-nozzle array ink jet print heads, wherein the plurality of nozzle portions jet predetermined ink to the recording paper sent in the sub-scanning direction every time when the forward scanning and the backward scanning are performed so as to form a stripped scanning printed area, corresponding to a scanning width of the sub-scanning direction of each of the plurality of nozzle portions, on the recording paper; and the plurality of multi-nozzle array ink jet print heads are structured to satisfy the relationship of $W<P<2W$ where an array pitch of the plurality of multi-nozzle array ink jet print heads is P, and the scanning width is W.

An embodiment of the above invention corresponds to first to sixth embodiments to be described later.

According to the above structure, generation of stripped patterns, which are caused by a change of the order of a color superimposition at the time of forward and backward scanning, can be prevented. At the same time, stripped patterns of stripped scanning boundaries of the respective colors can be prevented from being emphasized.

(2) In the ink jet printer of the present invention, the array pitch P satisfies the relationship of substantially $W\{1+(1/N')\}$ where N' corresponds to a number of heads of basic color ink or a number of heads of all colors.

According to the above structure, a maximum effect of prevention of stripped patterns can be obtained. Also, since the expansion of the arrangement area of the print heads in the sub-scanning direction can be controlled to be minimum, the enlargement of the apparatus and the increase in the memory capacity for printing can be prevented.

(3) In the ink jet printer of the present invention, the plurality of multi-nozzle array ink jet print heads comprise first to fourth multi-nozzle array ink jet print heads capable of recording yellow, magenta, cyan, and black ink onto the recording paper; and the first to third multi-nozzle array ink jet print heads capable of recording yellow, magenta, and cyan ink are arranged to have a pitch of 4W/3 along the sub-scanning direction, and the fourth multi-nozzle array ink jet print head capable of recording black ink is provided at an arbitrary position in the sub-scanning direction not to interfere with the first to third multi-nozzle ink jet print heads.

An embodiment of the above invention corresponds to the second embodiment.

According to the above structure, generation of the stripped patterns can be effectively prevented. Also, since the arrangement area of the print heads in the sub-scanning direction can be made small, the miniaturization of the apparatus can be achieved and the memory capacity for printing can be reduced.

(4) An ink jet printer comprises a plurality of low density multi-nozzle array ink jet print heads arranged in a sub-scanning direction where recording paper is sent, and capable of scanning forward and backward in a main scanning direction to record different color ink onto the recording paper; and a plurality of nozzle portions provided to each of the plurality of low density multi-nozzle array ink jet print heads, and having a nozzle pitch twice as large as a predetermined print dot pitch; wherein the plurality of nozzle portions jet predetermined ink to the recording paper sent in the sub-scanning direction every time when the forward scanning and the backward scanning are performed so as to form a stripped scanning printed area, corresponding to a scanning width of the sub-scanning direction of each of the plurality of nozzle portions, on the recording paper; and the plurality of low density multi-nozzle array ink jet printed heads are structured so to form a stripped scanning printed area through the plurality of nozzle portions at the time of the backward scanning in order to interlace with the stripped scanning print area formed at the time of the forward scanning, and the plurality of low density multi-nozzle ink jet print heads are structured to satisfy the relationship of $W<P<2W$ where an array pitch of the plurality of low density multi-nozzle ink jet print heads is P, and the scanning width is W.

An embodiment of the above invention corresponds to the third to sixth embodiments.

According to the above structure, generation of stripped patterns, which are caused by the change of the order of the color superimposition at the time of forward and backward scanning, and the generation of the stripped patterns of stripped print-dot boundaries of the respective colors can be solved and reduced. Thereby, there can be realized the printer in which the stripped patterns can be prevented from being emphasized.

(5) In the ink jet printer of the present invention, the array pitch P satisfies the relationship of substantially $W\{1+(1/N')\}$ where N' corresponds to a number of heads of basic color ink or a number of heads of all colors.

An embodiment of the above invention corresponds to the fourth to sixth embodiments.

According to the above structure, a maximum effect of prevention of stripped patterns can be obtained. Also, since the expansion of the arrangement area of the print heads in the sub-scanning direction can be controlled to be minimized, the enlargement of the apparatus and the increase in the memory capacity for printing can be prevented.

(6) In the ink jet printer of the present invention, the array pitch P satisfies the relationship of substantially $W\{1+(1/2N')\}$ where N' corresponds to a number of heads of basic color ink or a number of heads of all colors, and the recording paper is sent by substantially W/2 in the sub-scanning direction every time when the forward scanning of the low density multi-nozzle array ink jet print heads and the backward scanning thereof are performed.

An embodiment of the above invention corresponds to the fourth embodiment.

According to the above structure, the change of the order of color superimposition of ink at the time of the forward and backward scanning can be prevented. Also, the print boundary portions of the respective colors are dispersed to two portions in the scanning width W. Moreover, since the stripped boundary positions of the respective colors are shifted from each other, the stripped patterns of stripped scanning boundaries can be considerably prevented from being emphasized.

(7) In the ink jet printer of the present invention, the plurality of low density multi-nozzle array ink jet print heads are controlled to interlace with the stripped scanning print area every time when the forward scanning and the backward scanning are performed in order to form a stripped scanning print area having a predetermined print dot pitch in the main scanning and sub-scanning directions at the time of at least one of the forward and backward scanning, and the recording paper is sent by substantially W/4 in the sub-scanning direction every time when the forward scanning and the backward scanning are performed. An embodiment of the above embodiment corresponds to the fifth embodiment.

According to the above structure, in the print of the same color, the print boundary positions of the same color are dispersed to four portions in the scanning width W. Due to this, the stripped patterns of the stripped boundary portions of the respective colors can be prevented from being emphasized. Moreover, generation of stripped patterns, which are caused by the change of the order of the color superimposition at the time of forward and backward scanning, can be completely prevented.

Furthermore, if the value of the above-mentioned 1/N' is a value other than an integral multiple of 1/4, the stripes of the respective colors are shifted each other, the stripped patterns can be further reduced.

(8) In the ink jet printer of the present invention, the array pitch P satisfies the relationship of substantially W {1+(1/N')} where N' corresponds to a number of heads of basic color ink or a number of heads of all colors, and the recording paper is sent by substantially W/2 in the sub-scanning direction every time when the forward scanning of the low density multi-nozzle array ink jet print heads and the backward scanning thereof are performed.

An embodiment of the above invention corresponds to the sixth embodiment.

According to the above structure, the stripped patterns can be largely improved. Also, the expansion of the arrangement area of the print heads in the sub-scanning direction can be controlled to be minimum, the enlargement of the apparatus and the increase in the memory capacity for printing can be prevented. Moreover, even if a print mode of 400 DPI and a print mode of 800 DPI are selected by use of the print head having nozzle density of e.g., 400 DPI, there can be obtained a suitable effect of prevention of stripped patterns can be obtained by use of the structure of the present invention.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

An ink jet printer of a first embodiment of the present invention will be explained with reference to FIGS. 1 and 2.

Figure 1A:
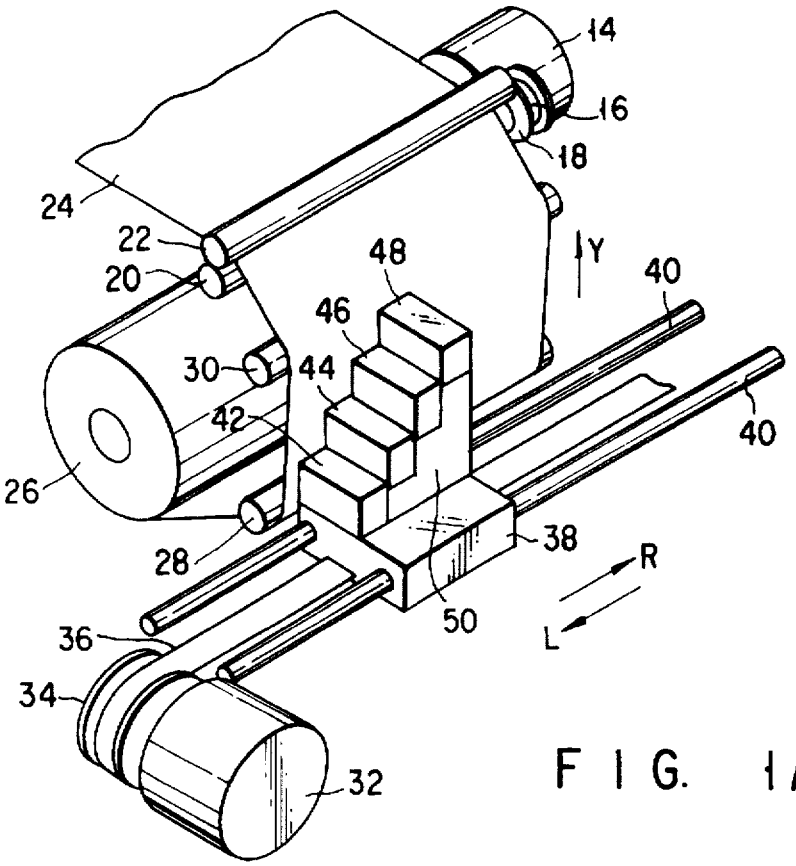
FIG. 1A is a perspective view schematically showing the structure of an ink jet printer relating to a first embodiment of the present invention.

As shown in FIG. 1A, in the ink jet printer of this embodiment, when driving force of a step motor 14 is transmitted to a pulley 18 through a belt 16, recording paper 24, which receives carrying force of a carrier roller 20 and a pinch roller 22, is delivered through a recording paper roll 26 to first and second guide rollers 28 and 30 in a sub-scanning direction Y by a predetermined timing.

Moreover, the ink jet printer of this embodiment comprises a carriage 38, which is fixed to an endless timing belt 36 stretched onto a pulley 34 of a main scanning motor 32. The carriage 38 is structured to be moved back and forth along a pair of guide rollers 40 extended in main scanning directions (L, R).

First to fourth multi-nozzle array ink jet print heads 42, 44, 46, and 48 are mounted on the carriage 38. These first to fourth multi-nozzle array ink jet print heads 42, 44, 46, and 48 are controlled such that four color ink can be jetted at the time of forward scanning and backward scanning.

More specifically, the first multi-nozzle array ink jet print head 42 is structured to jet yellow ink, and the second multi-nozzle array ink jet print head 44 is structured to jet magenta ink. Also, the third multi-nozzle array ink jet print head 46 is structured to jet cyan ink, and the fourth multi-nozzle array ink jet print head 48 is structured to jet black ink.

These first to fourth multi-nozzle array ink jet print heads 42, 44, 46, and 48 are supported by a support 50, which is mounted on the carriage 38. Also, these multi-nozzle array ink jet print heads 42, 44, 46, and 48 are arranged to have a predetermined pitch P in the sub-scanning direction Y and to have a fixed distance in the main scanning directions (L, R).

Since the above-structured ink jet printer of this embodiment is controlled to jet each ink when the carriage 38 scans forward and backward, a high speed printing can be executed as compared with a case of the printer in which each ink is jetted only when the carriage scans forward.

Moreover, according to the ink jet printer of this embodiment, generation of stripped patterns, which are caused by a change of the order of a color superimposition, can be prevented. At the same time, generation of stripped patterns, which are emphasized when stripped scanning boundaries of the respective colors are superimposed on each other, can be prevented.

Furthermore, various improvements to be described later are provided to the first to fourth multi-nozzle array ink jet print heads 42, 44, 46, and 48 applied to the ink jet printer of this embodiment.

Figure 1B:
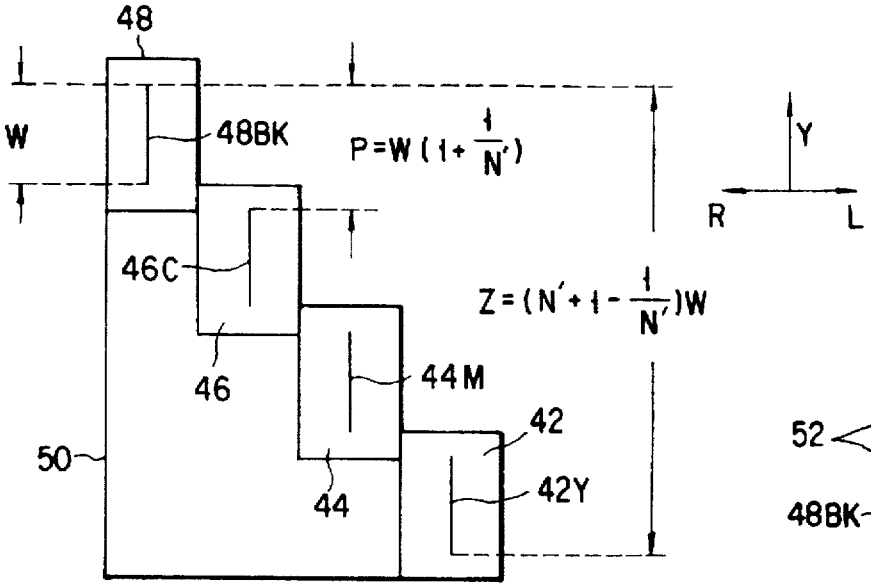
FIG. 1B is a plane view schematically showing the structure of multi-nozzle array ink jet print heads seen from the side of recording paper.

FIG. 1B schematically shows the structure of these first to fourth multi-nozzle array ink jet print heads 42, 44, 46, and 48 seen from the side of recording paper 24, and the carriage 38 is not shown in this figure.

Figure 1C:
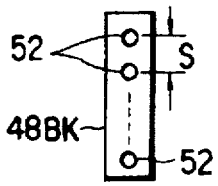
FIG. 1C is a plane view showing the structure of each nozzle portion.

More specifically, as shown in FIGS. 1B and 1C, first to fourth multi-nozzle array ink jet print heads 42, 44, 46, and 48 have first to fourth nozzle units 42Y, 44M, 46C and 48BK, respectively. Each of the first to fourth nozzle units 42Y, 44M, 46C and 48BK has a plurality of nozzle portions 52 (FIG. 1C) arranged along the sub-scanning direction Y to have a distance S, which is equal to a predetermined print dot pitch. Though FIG. 1C shows only the structure of the fourth nozzle unit 48BK, the other first to third nozzle units 42Y, 44M, and 46C are not illustrated since they have the same structure as the fourth nozzle unit 48BK.

If a scanning width of the sub-scanning direction Y of each of the first to fourth nozzle units 42Y, 44M, 46C, and 48BK is W, an array pitch P of the sub-scanning direction Y of each of the first to fourth nozzle units 42Y, 44M, 46C, and 48BK is set to satisfy an inequality of $W<P<2W$ (FIG. 1B).

Moreover, the array pitch P is preferably set to satisfy an equation of $P=W\{1+(1/N')\}$. In this embodiment, natural number 4, which corresponds to the number of ink, is used as N'.

According to the above-mentioned structure, if the carriage 38 is scanned forward and backward in the main scanning directions (L, R), each ink having a scanning width W is printed band-like on recording paper 24 to be shifted by only a fixed distance along the main scanning directions (L, R).

As mentioned above, since the first to fourth multi-nozzle array ink jet print heads 42, 44, 46, and 48 are arranged to be shifted each other along the sub-scanning direction Y, the total width Z of the sub-scanning direction where the first to fourth multi-nozzle array ink jet print heads 42, 44, 46, and 48 scan in the first main scanning can be expressed as follows.

$$Z=W\{N'+1-(1/N')\}$$

In this embodiment, since N'=4, the total width can be expressed as follows.

$$Z=W\{4+(3/4)\}$$

It is noted that the first to fourth multi-nozzle array ink jet print heads 42, 44, 46, and 48 applied to this embodiment are supported by the support 50 formed on the carriage 38 in order to satisfy the above-mentioned condition.

Figure 2:
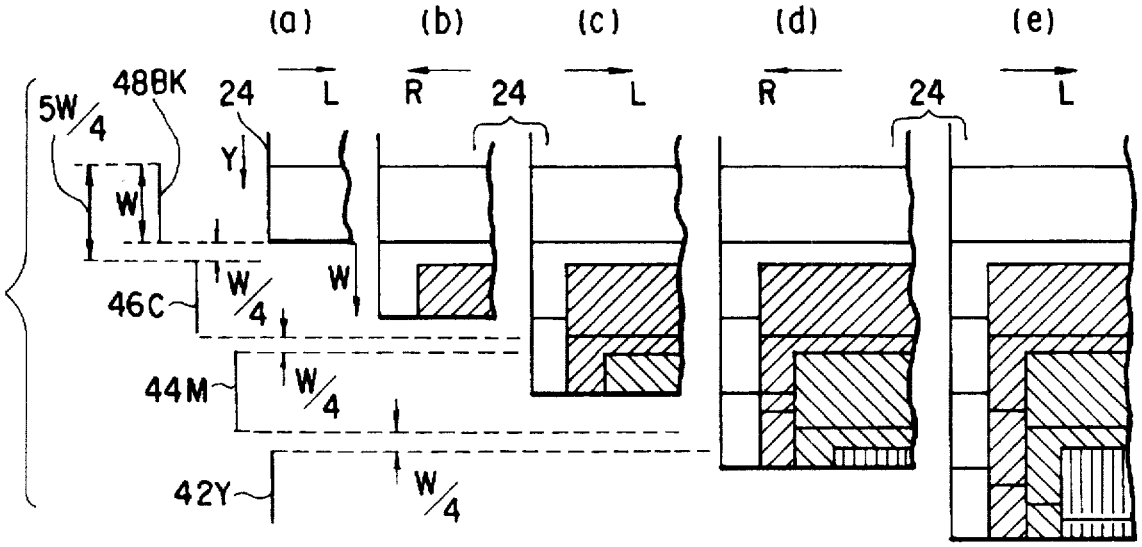
FIG. 2 is a view explaining an operation of the first embodiment of the present invention.

The following will explain an operation of this embodiment with reference to FIG. 2. In this figure, only the first to fourth nozzle units 42Y, 44M, 46C, and 48BK are shown.

FIG. 2(*a*) shows a state in which the first forward scanning (hereinafter called L) in the direction L of the main scanning directions (L, R) is ended.

Under this state, a top end portion of the recording paper 24 sent in the sub-scanning direction Y is positioned in the scanning area (specifically corresponding to the scanning width W) of the fourth nozzle unit 48BK.

As shown in FIG. 2(*a*), at the first forward scanning L, the first to fourth nozzle units 42Y, 44M, 46C, and 48BK are main-scanned in the direction L. Thereby, black ink jetted from the plurality of nozzle portions 52 of the fourth nozzle unit 48BK is printed in a strip form in a stripped scanning area (white ground portion) on the recording paper 24.

FIG. 2(*b*) shows a state in which the first backward scanning (hereinafter called R) in the direction R is ended.

After the end of the first forward scanning L, the recording paper 24 is sent in the sub-scanning direction Y by only an amount corresponding to the scanning width W before the first backward scanning R is started. Then, the first to fourth nozzle units 42Y, 44M, 46C, and 48BK are main-scanned in the direction R. Thereby, cyan ink, which is jetted from the plurality of nozzle portion 52 of the third nozzle unit 46C, is superimposed and printed on the recording paper 24 where black ink is superimposed and printed (shown by right upward slant lines in FIG. 2(*b*)). At the same time, black ink, which is jetted from the fourth nozzle unit 48BK, is printed on the recording paper 24 adjacent to black ink printed in the above process (a).

In the actual operation, color superimposition and print staring positions of the respective colors are conformed to the left end portion of recording paper 24 on the left in FIG. 2. However, in this figure, color superimposing and print staring positions of the respective colors are shown to be shifted each other to correspond to the arrangement of the first to fourth nozzle units 42Y, 44M, 46C, and 48BK in order to easily discriminate the color superimposing position.

FIG. 2(*c*) shows a state in which the second forward scanning L in the direction L is ended.

After the end of the first backward scanning R, the recording paper 24 is sent in the sub-scanning direction Y by only an amount corresponding to the scanning width W before the second forward scanning L is started. Then, the first to fourth nozzle units 42Y, 44M, 46C, and 48BK are main-scanned in the direction L. Thereby, magenta ink, which is jetted from the plurality of nozzle portion 52 of the second nozzle unit 44M, is superimposed and printed on the top end portion of the recording paper 24 where black ink and cyan ink are superimposed and printed (shown by right upward slant lines in FIG. 2(*c*)). At the same time, cyan ink, which is jetted from the third nozzle unit 46C, is superimposed and printed onto cyan ink printed in the above process (b) adjacent to each other. Also, black ink, which is jetted from the fourth nozzle unit 48BK, is superimposed and printed onto the recording paper 24 adjacent to black ink printed in the above process (b).

FIG. 2(*d*) shows a state in which the second backward scanning R in the direction R is ended.

After the end of the second forward scanning L, the recording paper 24 is sent in the sub-scanning direction Y by only an amount corresponding to the scanning width W before the second backward scanning R is started. Then, the first to fourth nozzle units 42Y, 44M, 46C, and 48BK are main-scanned in the direction L. Thereby, yellow ink, which is jetted from the plurality of nozzle portion 52 of the first nozzle unit 42Y, is superimposed and printed on the top end portion of the recording paper 24 where black ink, cyan ink, and magenta ink are superimposed and printed (shown by vertical lines in FIG. 2(*d*)). At the same time, magenta ink, which is jetted from the second nozzle unit 44M, is superimposed and printed onto magenta ink printed in the above process (c) to be adjacent to each other. Also, cyan ink, which is jetted from the third nozzle unit 46C, is superimposed and printed onto cyan ink printed in the above process (c) to be adjacent to each other. Moreover, at the same time, black ink, which is jetted from the fourth nozzle unit 48BK, is superimposed and printed onto the recording paper 24 adjacent to black ink printed in the above process (c).

FIG. 2(*e*) shows a state in which the third forward scanning L in the direction L is ended.

After the end of the second backward scanning R, the recording paper 24 is sent in the sub-scanning direction Y by only an amount corresponding to the scanning width W before the third forward scanning L is started. Then, the first to fourth nozzle units 42Y, 44M, 46C, and 48BK are main-scanned in the direction L. Thereby, yellow ink, which is jetted from the first nozzle unit 42Y, is superimposed and printed onto the yellow ink printed in the process (d) to be adjacent to each other. At the same time, magenta ink, which is jetted from the second nozzle unit 44M, is superimposed and printed onto magenta ink printed in the above process (d) to be adjacent to each other. Also, cyan ink, which is jetted from the third nozzle unit 46C, is superimposed and printed onto cyan ink printed in the above process (d) to be adjacent to each other. Moreover, at the same time, black ink, which is jetted from the fourth nozzle unit 48BK, is superimposed and printed onto the recording paper 24 adjacent to black ink printed in the above process (d).

According to the ink jet printer of this embodiment, color ink is always superimposed on the recording paper 24 in order of black, cyan, magenta, and yellow in either case, that is, the forward scanning and the backward scanning.

The reason why the order of the color superimposition is unchanged at the time of the forward and backward scanning is that the first to fourth nozzle units 42Y, 44M, 46C, and 48BK are structured to have the array pitch P (=5W/4), which is more than the scanning width W, in the sub-scanning direction Y.

In the above-mentioned structure, the recording paper 24 is sent in the sub-scanning direction Y by only a fixed scanning width W. The first to fourth nozzle units 42Y, 44M, 45C and 48BK faces with each other individually in accordance with the above array order every main scanning direction (L, R), so that color ink can be superimposed and printed onto the recording paper 24 in the above array order.

As a result, as shown in FIG. 2, the boundary positions of the color-superimposed and printed bandlike ink are shifted each other. More specifically, the amount of shift becomes W/N' from the relationship between the scanning width W and the array pitch P. In the above embodiment, N' is 4, which is the total number of ink colors, so that the amount of shift becomes W/4.

As mentioned above, the print boundary positions of the respective ink are shifted each other. Due to this, even if the same stripped patterns exist in the respective ink, it is possible to restrain the function in which the stripped patterns concentrate on one portion to be strengthened with each other, so that the stripped patterns are visually seen. As a result, the stripped patterns can be prevented from being emphasized.

Therefore, according to this embodiment, there can be provided an ink jet printer in which generation of stripped patterns, which are caused by a change of the order of a color superimposition, can be prevented and generation of stripped patterns, which is emphasized when stripped scanning boundaries of the respective colors are superimposed on each other, can be prevented.

If the array pitch P of the sub-scanning direction Y of each of the first to fourth nozzle units 42Y, 44M, 46C, and 48BK is made larger, the total width Z of the sub-scanning direction Y of the recording paper 24 is increased. As a result, the guide mechanism for ensuring the order of the high accurate color superimposition becomes complicated. Moreover, if the total width is increased, an area where no recording is performed on the top end portion of paper due to the restriction of the paper delivering mechanism is generated and invalid portions of the recording paper 24 are increased.

Therefore, it is not preferable that the array pitch P be made larger than necessity. As shown in this embodiment, the array pitch P is preferably set to satisfy inequality of $W<P<2W$. If the array pitch P is set to $2W<P$, no advantage is increased, and only disadvantage is increased.

In order to exert the advantage of this embodiment, the total width Z and the scanning width are preferably set to satisfy the relationship of $$W\,(0.5+N')<Z<W\,(1+N').$$

Moreover, in a case where the number of first to fourth nozzle units 42Y, 44M, 46C, and 48BK is N', each nozzle portions is equally shifted, so that the maximum advantage can be obtained, the above-mentioned disadvantage can be controlled to be minimum. Therefore, as mentioned above, the array pitch P is preferably set to satisfy the equation, $$P=W\,\{1+(1/N')\}.$$

In this case, N' is the number of all ink or the number of basic ink, that is, three colors of cyan, magenta, yellow. It is noted that there is a case in which special color ink is added in addition to the above three colors and black. In this case, it is not needed that all nozzle portions, which correspond to all number of ink N', are relatively shifted.

Furthermore, it is not needed that the first to fourth nozzle units 42Y, 44M, 46C, and 48BK are arranged with a completely equal array pitch P. Even if the array pitch is changed to the array pitch, which is different from the unequal array pitch P or $P=W\,\{1+(1/N')\}$, in the range where the advantage can be obtained, that is, the range satisfying the relationship of $W<P<2W$, the same advantage as the above embodiment can be exerted.

Figures 3A, 3B, 3C:
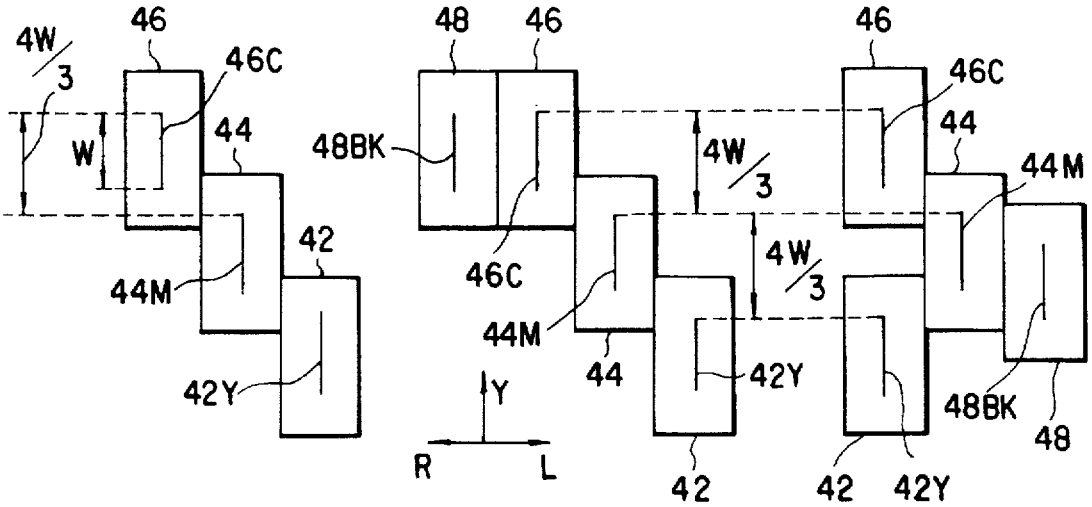
FIGS. 3A, 3B, and 3C are plane views each schematically showing the structure of multi-nozzle ink jet print heads applied to an ink jet printer of a second embodiment of the present invention.

The following will explain an ink jet printer of a second embodiment of the present invention with reference to FIGS. 3A to 3C. In the explanation of this embodiment, the same reference numerals are added to the structure common to FIGS. 1A to 1C, and the explanation is omitted.

The ink jet printer of this embodiment is structured such that the stripped patterns, which are caused by the change of the order of the color superimposition at the time of forward and backward scanning, can be completely removed, and the increase in the array area of the sub-scanning direction Y (FIGS. 1A and 1B) of the first to third multi-nozzle array ink jet print heads 42, 44, 46, can be prevented to the utmost. Since the other structure of this embodiment is the same as the structure of FIG. 1A to 1C, the following will explain only the characteristic portions.

More specifically, the ink jet printer of FIG. 3A comprises first to third multi-nozzle array ink jet print heads 42, 44, and 46, which are controlled to jet at least three colors ink, that is, cyan, magenta, yellow ink at the time of forward and backward scanning. In other words, the fourth multi-nozzle array ink jet print heads 48 is removed from the first to fourth multi-nozzle array ink jet print heads 42, 44, 46, 48 shown in FIG. 1B.

The first to third nozzle units 42Y, 44M, and 46C of the first to third multi-nozzle array ink jet print heads 42, 44, and 46 are structured such that the array pitch, which corresponds to symbol P of FIG. 1B, is set to be 4W/3.

According to the above-mentioned structure, it is possible to obtain full-colored print by use of only the above three colors. Even if black ink is used, generation of the stripped patterns, which are caused by the change of the order of the color superimposition at the time of forward and backward scanning, can be completely prevented by considering the array structure of the first to third nozzle units 42Y, 44M, and 46C and the scanning control.

Moreover, according to the structure in which the first to third nozzle units 42Y, 44M, and 46C are arranged in the sub-scanning direction with a predetermined array pitch, the total width (shown by Z of FIG. 1B) of the sub-scanning direction can be reduced as compared with the case in which four nozzle units of FIG. 1B are arranged.

As a result, the structure of the ink jet printer can be simplified and the invalid portions of recording paper 24 (FIG. 1A) can be reduced.

The ink jet printer of FIG. 3B comprises first to fourth multi-nozzle array ink jet print heads 42, 44, 46, and 48, which are controlled to jet four colors ink, that is, black, cyan, magenta, yellow ink at the time of forward and backward scanning. More specifically, among the multi-ink jet printer heads of FIG. 3A, the fourth multi-nozzle array ink jet print head 48 is arranged to be adjacent to the left side in the figure of the third multi-nozzle array ink jet print head 46.

According to the above-mentioned arrangement, the fourth multi-nozzle array ink jet print head 48 does not interfere with the other first to third multi-nozzle array ink jet print head 42, 44, and 46 in the main scanning directions (R, L) in view of the arrangement. In the range where no interference occurs, the fourth multi-nozzle array ink jet print head 48 can be provided at an arbitrary position of the area of the sub-scanning direction Y.

Normally, various structural members are provided around the first to fourth nozzle units 42Y, 44M, 46C, and 48BK. Due to this, if the first to third multi-nozzle array ink jet print heads 42, 44, 46, 48 are arranged to have the array pitch of 4W/3 in the sub-scanning direction, it is difficult to arrange the first to third nozzle units 42Y, 44M, and 46C of the first to third multi-nozzle array ink jet print heads 42, 44, 46, and 48 at the same position seeing from the main scanning direction.

Therefore, by applying the arrangement shown in FIG. 3B, the change of the order of the color superimposition can be prevented at the time of forward and backward scanning. Moreover, the total width Z of the sub-scanning direction Y can be reduced. As a result, the structure of the ink jet printer can be simplified and the invalid portions of recording paper 24 (FIG. 1A) can be reduced.

The ink jet printer of FIG. 3C comprises first to fourth multi-nozzle array ink jet print heads 42, 44, 46, and 48, which are controlled to jet four colors ink, that is, black, cyan, magenta, yellow ink at the time of forward and backward scanning.

More specifically, as shown in 3C, the first and third multi-nozzle array ink jet print heads 42 and 46 are arranged in the sub-scanning direction Y and the second multi-nozzle array ink jet print head 44 is arranged to be adjacent to the right side in the figure of the first and third multi-nozzle array ink jet print heads 42 and 46. And the first to third nozzle units 42Y, 44M, and 46C of the first to third multi-nozzle array ink jet print heads 42, 44, and 46 are structured such that the array pitch is set to be 4W/3 in the sub-scanning direction. Moreover, the fourth multi-nozzle array ink jet print head 48 is arranged to be adjacent to the right side in the figure of the second multi-nozzle array ink jet print head 44. The fourth multi-nozzle array ink jet print head 48 is relatively shifted against the second multi-nozzle array ink jet print head 44 in the sub-scanning direction Y.

The arrangement of the fourth multi-nozzle array ink jet print head 48 in the sub-scanning direction Y can be arbitrarily set. However, the fourth multi-nozzle array ink jet print head 48 is arranged in the area of the total width of the sub-scanning direction Y of the first to third multi-nozzle array ink jet print heads 42, 44, and 46, thereby making it possible to reduce not only the total width Z of the sub-scanning direction Y but also the total length of the main scanning direction (R, L). As a result, in addition to the advantage based on the structure of FIGS. 3A and 3B, the delivery length of the multi-nozzle array ink jet print heads to the main scanning directions (R, L) can be reduced, so that the size of the jet printer can be further made compact.

Figure 4:
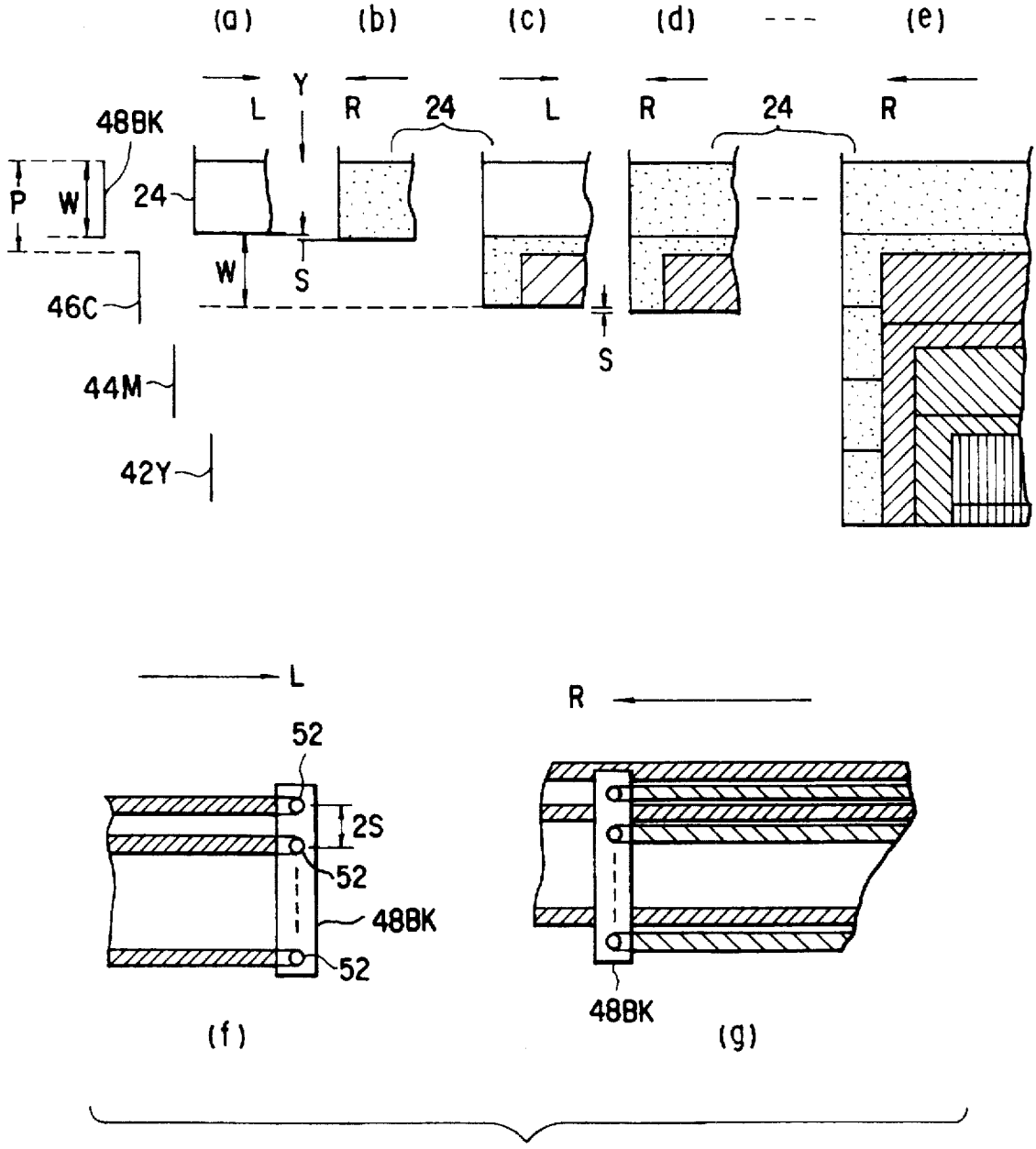
FIG. 4 is a view explaining an operation of an ink jet printer of a third embodiment of the present invention.

The following will explain an ink jet printer of a third embodiment of the present invention with reference to FIG. 4. In the explanation of this embodiment, the same reference numerals are added to the structure common to FIGS. 1A to 1C, and FIG. 2, and the explanation is omitted.

In the first to fourth nozzle units 42Y, 44M, 46C, and 48BK, which are applied to the first and second embodiments, the plurality of nozzle portions 52 (FIG. 1C) are arranged along the sub-scanning direction Y with distance S, which is equal to predetermined print dots pitch.

In contrast, in the first to fourth nozzle units 42Y, 44M, 46C, and 48BK, which are applied to the third embodiment, the plurality of nozzle portions 52 are provided along the sub-scanning direction Y with distance 2S, which is twice as large as the the predetermined print dot pitch, as shown in FIG. 4(*f*). Therefore, if the number of nozzle portions 52 is n, 2nS becomes the scanning width W. FIG. 4(*f*) and FIG. 4(*g*) show only the structure of the fourth nozzle unit 48BK. However, since the other nozzle units 42Y, 44M and 46C are the same, the explanation is omitted. Moreover, since the structure of the other ink jet printer is the same as the case of FIG. 1A, and the arrangement of the first to the fourth multi-nozzle array ink jet print heads 42, 44, 46, and 48 is the same, the explanation is omitted.

As mentioned above, since the space 2S of each of the nozzle portions 52 is large, the first to fourth multi-nozzle array ink jet print heads 42, 44, 46, and 48 each having the above-arranged nozzle portions 52 can be easily manufactured, and high-speed printing can be performed with low dot density.

The following will explain the operation of this embodiment having the above-mentioned structure.

FIG. 4(*a*) shows a state in which the first forward scanning (hereinafter called L) in the direction L of the main scanning directions (L, R) is ended.

Under this state, the top end portion of the recording paper 24 sent in the sub-scanning direction Y is positioned in the scanning area (specifically corresponding to the scanning width W) of the fourth nozzle unit 48BK.

As shown in FIG. 4(*a*), at the first forward scanning L, the first to fourth nozzle units 42Y, 44M, 46C, and 48BK are main-scanned in the direction L. Thereby, black ink jetted from the plurality of nozzle portions of the fourth nozzle unit 48BK is printed as strip lines having distance 2S (shown by slant lines written right upward in FIG. 4(*f*)) on the stripped scanning area on the recording paper 24 (white ground portion).

FIG. 4(*b*) shows a state in which the first backward scanning (hereinafter called R) in the direction R is ended.

After the end of the first forward scanning L, the recording paper 24 is sent by only distance S (½ of distance 2S between the nozzle portions 52) in the sub-scanning direction Y before the first backward scanning (R) is started. Then, the first to fourth nozzle units 42Y, 44M, 46C, and 48BK are main-scanned in the direction R. Thereby, on the recording paper 24 of the top portion where black ink is printed as stripped lines (right upward slant lines: preceding black lines), black ink jetted from the fourth nozzle unit 48BK is printed as stripped lines (shown by slant right downward lines in FIG. 4(*g*)) as interlacing the preceding black lines.

As a result, black ink is printed on the top portion of the recording paper 24 corresponding to the scanning width W with a predetermined density (sand portion of FIG. 4(*b*)).

FIG. 4(*c*) shows a state in which the second forward scanning L in the direction L is ended.

After the end of the first backward scanning R, the recording paper 24 is sent by only distance W−S (a distance obtained by subtracting ½ of distance 2S between the nozzle portions 52 from the scanning width W) in the sub-scanning direction Y before the second forward scanning L is started. Then, the first to fourth nozzle units 42Y, 44M, 46C, and 48BK are main-scanned in the direction L. Thereby, on the recording paper 24 of the top portion where black ink is printed with the predetermined density, cyan ink jetted from the third nozzle unit 46C is superimposed and printed (shown by right upward slant lines in FIG. 4(*c*)) as stripped lines having distance 2S (FIG. 4(*f*)). At the same time, black ink jetted from the fourth nozzle unit 48BK, serving as stripped lines having distance 2S, is printed on the recording paper 24 to be adjacent to black ink printed with the predetermined density (FIG. 4(*f*)).

FIG. 4(*d*) shows a state in which the second backward scanning R in the direction R is ended.

After the end of the second forward scanning L, the recording paper 24 is sent by only distance S (½ of distance 2S between the nozzle portions 52) in the sub-scanning direction Y before the second backward scanning R is started. Then, the first to fourth nozzle units 42Y, 44M, 46C, and 48BK are main-scanned in the direction R. Thereby, on a portion where cyan ink is superimposed and printed as stripped lines (preceding cyan lines), cyan ink jetted from the third nozzle unit 46C is printed as strip lines (FIG. 4(*g*)) as interlacing the preceding cyan lines. At the same time, on a portion where black ink is printed as stripped lines (preceding black lines) in the above process (g), black ink jetted from the fourth nozzle unit 48BK is printed as interlacing the preceding black lines.

As a result, on the top end portion of the recording paper 24, cyan ink is superimposed and printed on black ink printed with the predetermined density. Also, on the recording paper 24 adjacent thereto, black ink is printed with a predetermined density.

By repeating the above-mentioned forward and backward scanning (R, L), black (sand portion), cyan (right upward slant lines), magenta (right downward slant lines), and yellow (vertical lines) are superimposed and printed on the recording paper 24 in order as shown in FIG. 4(*e*).

According to the above-explained superimposition and printing, since the boundaries of the respective stripped ink in the sub-scanning direction Y are shifted each other, the stripped patterns are not emphasized. Moreover, the order of superimposition of the stripped ink is black, cyan, magenta, and yellow. Since the order is the same at the arbitrary portion of the recording paper 24, the stripped patterns can be completely removed.

Therefore, according to the structure of the above embodiment, generation of the stripped patterns, which are caused by the change of the order of the color superimposition at the time of forward and backward scanning, can be completely prevented. Moreover, since the stripped boundary positions of the respective ink are dispersely placed in the scanning width W in the sub-scanning direction Y, the stripped patterns of the boundary portions of the respective ink can be prevented from being emphasized.

Figure 5:
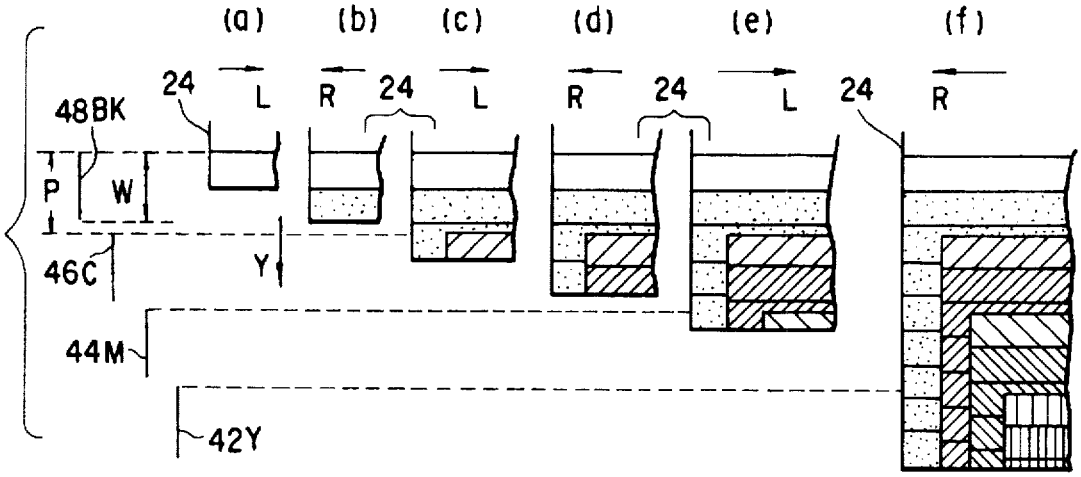
FIG. 5 is a view explaining an operation of an ink jet printer of a fourth embodiment of the present invention.

The following will explain an ink jet printer of a fourth embodiment of the present invention with reference to FIG. 5. In the explanation of this embodiment, the same reference numerals are added to the structure common to FIGS. 1A to 1C, and FIG. 4, and the explanation is omitted.

In the first to fourth nozzle units 42Y, 44M, 46C, and 48BK, which are applied to this embodiment, the plurality of nozzle portions 52 (FIG. 1C), which are arranged along the sub-scanning direction Y with distance 2S, which is twice as large as a predetermined print dot pitch, are provided. Therefore, if the number of nozzle portions 52 is n, 2nS becomes the scanning width W. FIG. 4(*f*) and FIG. 4(*g*) show only the structure of the fourth nozzle unit 48BK. However, since the other nozzle units 42Y, 44M and 46C are the same, the explanation is omitted. Moreover, since the structure of the other ink jet printer is the same as the case of FIG. 1A, and the arrangement of the first to the fourth multi-nozzle array ink jet print heads 42, 44, 46, and 48 is the same, the explanation is omitted.

In this embodiment, the array pitch P of the first to fourth nozzle units 42Y, 44M, 46C, and 48BK is set to $P=W\{1+(1/2N')\}$. In this case, N' corresponds to the number of basic ink or the number of all ink. Moreover, the recording paper 24 is sent by W/2 in the sub-scanning direction Y every time when the forward scanning or the backward scanning is performed.

Therefore, in this embodiment, since the number N' of all ink is 4, the array pitch is 9W/8.

The following will explain an operation of the above-explained embodiment.

FIG. 5(*a*) shows a state in which the first forward scanning (hereinafter called L) in the direction L of the main scanning directions (L, R) is ended.

Under this state, the top end portion of the recording paper 24, which is sent by W/2 in the sub-scanning direction, is positioned in the scanning area (specifically corresponding to the scanning width W) of the fourth nozzle unit 48BK.

As shown in FIG. 5(*a*), at the first forward scanning L, the first to fourth nozzle units 42Y, 44M, 46C, and 48BK are main-scanned in the direction L. Thereby, black ink jetted from the plurality of nozzle portions of the fourth nozzle unit 48BK is printed as strip lines having distance 2S (shown by slant lines written right upward in (f) of FIG. 4) on the stripped scanning area on the recording paper 24 (white ground portion).

FIG. 5(*b*) shows a state in which the first backward scanning (hereinafter called R) in the direction R is ended.

After the end of the first forward scanning L, the recording paper 24 is further sent by only W/2 in the sub-scanning direction Y before the first backward scanning R is started. Then, the first to fourth nozzle units 42Y, 44M, 46C, and 48BK are main-scanned in the direction R. Thereby, on the recording paper 24 of the top portion where black ink is printed as stripped lines (preceding black lines), black ink jetted from the fourth nozzle unit 48BK is printed as stripped lines (shown by a sand portion in (b) of FIG. 5) as interlacing the preceding black lines ((g) of FIG. 4). At the same time, on the recording paper 24 adjacent to the top end portion, black ink jetted from the fourth nozzle unit 48BK is printed as stripped lines with distance 2S ((f) of FIG. 4).

As a result, black lines are printed on the top portion of the recording paper 24 corresponding to the scanning width W with a predetermined density (sand portion of FIG. 5(*b*)). At the same time, black ink is printed on the recording paper 24 adjacent to the top end portion as stripped lines having distance 2S.

FIG. 5(*c*) shows a state in which the second forward scanning L in the direction L is ended.

After the end of the first backward scanning R, the recording paper 24 is further sent by only distance W/2 in the sub-scanning direction Y before the second forward scanning L is started. Then, the first to fourth nozzle units 42Y, 44M, 46C, and 48BK are main-scanned in the direction L. Thereby, on the recording paper 24 of the top portion where black ink is printed with the predetermined density, cyan ink jetted from the third nozzle unit 46C is superimposed and printed (right upward lines in (c) of FIG. 5) as stripped lines having distance 2S (FIG. 4(*f*)). At the same time, on a portion where black ink is printed as stripped lines in the process (b) (preceding black lines), black ink jetted from the fourth nozzle unit 48BK is printed (sand portion in FIG. 5(*c*)) as interlacing the preceding black lines (FIG. 4(*g*)). Moreover, at the same time, on the recording paper 24, which is sent by only W/2 in the scanning width W of the fourth nozzle unit 48BK (white ground portion adjacent to the sand portion), black ink jetted from the fourth nozzle unit 48BK is printed as stripped lines having distance 2S (FIG. 4(*f*)).

By providing the respective processes (d) and (e) of FIG. 5, black (sand portion), cyan (right upward slant lines), magenta (right downward slant lines), and yellow (vertical lines) are superimposed and printed in a stripped form on the recording paper 24 in order as shown in FIG. 5(*f*).

According to the above color superimposition and printing, the boundaries of the respective stripped ink in the sub-scanning direction Y are shifted each other by only W/2N'. Moreover, the repetition of the stripped print boundaries of each color ink becomes short every W/2. Due to this, the print boundaries of the respective ink are thin and dispersely provided in the sub-scanning direction Y. As a result, the stripped patterns can be prevented from being emphasized. Moreover, the order of superimposition of the stripped ink is black, cyan, magenta, and yellow. Since the order is the same at the arbitrary portion of the recording paper 24, the stripped patterns can be completely removed.

Therefore, according to the structure of the above embodiment, generation of the stripped patterns, which are caused by the change of the order of the color superimposition at the time of forward and backward scanning, can be completely prevented. Moreover, since the stripped boundary positions of the respective ink are dispersely placed in the scanning width W in the sub-scanning direction Y, the stripped patterns of the boundary portions of the respective ink can be prevented from being emphasized.

By the way, regarding the structure for carrying out a predetermined printing with a print-dot pitch shorter than the nozzle pitch by the plurality of the nozzle portions applied to the multi-nozzle ink jet print heads, such the structure is needed in not only the printer shown in FIGS. 4 and 5 but also a printer in which a printer mode with a high dot density and a printer mode with a low dot density can be selected.

For example, in a printer on which multi-nozzle ink jet print heads having a plurality of nozzles arranged in the sub-scanning direction with a pitch of 0.0635 millimeter in order to carry out printing of standard 400 DPI, it is preferable that the following structure should be provided to improve a print quality of 800 DPI in case where a high density recording of the print mode 800 DPI.

Figure 6:
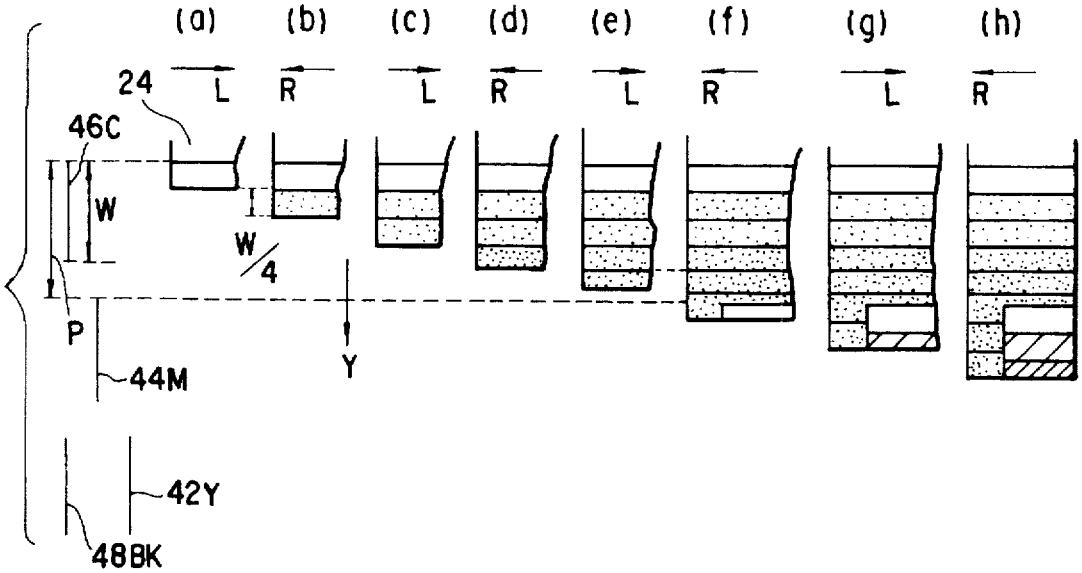
FIG. 6 is a view explaining an operation of an ink jet printer of a fifth embodiment of the present invention.
Figure 7:
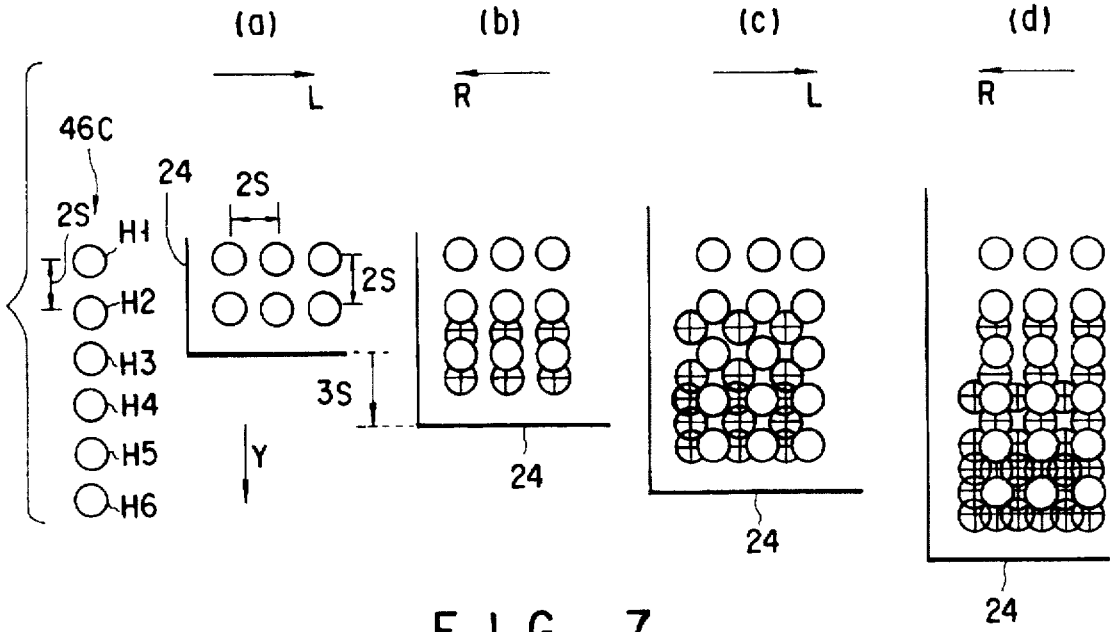
FIG. 7 is a view showing a state in which a dot-printing is performed as each ink is interlaced by the ink jet printer of the fifth embodiment.

More specifically, in order to satisfy the above-mentioned requirement, FIGS. 6 and 7 show the main structure of an ink jet printer of a fifth embodiment of the present invention. In the explanation of this embodiment, the same reference numerals are added to the structure common to FIGS. 1A to 1C and FIG. 4, and the explanation is omitted.

The ink jet printer of this embodiment comprises the first to fourth multi-nozzle array ink jet print heads 42, 44, 46, and 48 each having N number of nozzle portions. The first to fourth multi-nozzle array ink jet print heads 42, 44, 46, and 48 are arranged in the sub-scanning direction Y where the recording paper 24 is sent, and can scan forward and backward in the main scanning directions (R, L). These multi-nozzle array ink jet print heads are structured such that predetermined ink is jetted from N number of nozzle portions to the recording paper 24, which is sent in the sub-scanning direction Y every forward scanning L and backward scanning R, and a stripped scanning print area, which corresponds to the scanning width W in the sub-scanning direction Y of N number of nozzle portions, is formed on the recording paper 24.

More specifically, in this embodiment, there are provided first to fourth multi-nozzle array ink jet print heads 42, 44, 46 and 48 having first to fourth nozzle units 42Y, 44M, 46C and 48BK arranged as shown in FIG. 6.

In this embodiment, the array pitch P of the first to fourth nozzle units 42Y, 44M, 46C, and 48BK is set to P=W {1+(1/N')}. In this case, N' corresponds to the number of basic ink or the number of all ink. Moreover, the recording paper 24 is sent by W/4 in the sub-scanning direction Y every time when the forward scanning or the backward scanning is performed.

More specifically, in this embodiment, the number of nozzle portions, that is, the number of basic ink corresponds to the first to third nozzle units 42Y, 44M, 46C. That is, N'=3. Therefore, the array pitch P is 4W/3 in the sub-scanning direction Y. The array pitch P of the nozzle units including the fourth nozzle unit 48BK may be 5W/4 or a value close to 5W/4.

In these nozzle units 42Y, 44M, 46C, and 48BK, the plurality of nozzle portions 52 are provided along the sub-scanning direction Y with distance 2S, which is twice as large as the the predetermined print dot, as shown in FIG. 4(*f*). Therefore, if the number of nozzle portions 52 is n, 2nS becomes the scanning width W. FIG. 4(*f*) and FIG. 4(*g*) show only the structure of the fourth nozzle unit 48BK. However, since the other nozzle units 42Y, 44M and 46C are the same, the explanation is omitted. Moreover, since the structure of the other ink jet printer is the same as the case of FIG. 1A, and the explanation is omitted.

The following will explain an operation of the above-explained embodiment with reference to FIGS. 6 and 7.

FIG. 6(*a*) and FIG. 7(*a*) show a state in which the first forward scanning (hereinafter called L) in the direction L of the main scanning directions (L, R) is ended.

Under this state, the top end portion of the recording paper 24, which is sent by W/4 in the sub-scanning direction, is positioned in the scanning area (specifically corresponding to the scanning width W) of the third nozzle unit 46C.

Particularly, as shown in FIG. 6(*a*), at the first forward scanning L, the first to fourth nozzle units 42Y, 44M, 46C, and 48BK are main-scanned in the direction L. Thereby, cyan ink jetted from the nozzle portions 52 (FIG. 4(*f*)) of the third nozzle unit 46C is dot-printed to have distance 2S on the stripped scanning area on the recording paper 24 (white ground portion).

More specifically, as shown in FIG. 7(*a*), in the third nozzle unit 46C, first to six nozzle portions (H1, H2, H3, H4, H5, H6) are formed. Cyan ink, which is jetted from the first and second nozzle portions H1 and H2, is dot-printed on the top end portion of the recording paper 24, which is sent by W/4 (white ○ mark in FIG. 7(*a*)). In this case, the space between the printed dots is 2S along each of the sub-scanning direction Y and the main scanning directions (R, L).

FIG. 6(*b*) and FIG. 7(*b*) show a state in which the first backward scanning (hereinafter called R) in the direction R is ended.

After the end of the first forward scanning L, the recording paper 24 is further sent by only W/4 (corresponding to distance 3S) in the sub-scanning direction Y before the first backward scanning (R) is started. Then, the first to fourth nozzle units 42Y, 44M, 46C, and 48BK are main-scanned in the direction R. Thereby, on the recording paper 24 of the top portion where cyan ink is already dot-printed (preceding cyan dots) (○ mark having a cross therein in FIG. 7(*b*)), cyan ink jetted from the second and third nozzle portions H2 and H3 is dot-printed. In this case, cyan ink is dot-printed on the recording paper 24 as interlacing the preceding cyan dots in the sub-scanning direction Y at the same address position in the main scanning direction (FIG. 7(*b*)). At the same time, cyan ink jetted from the first nozzle portion H1 is dot-printed (FIG. 7(*b*)).

FIG. 6(*c*) and FIG. 7(*c*) show a state in which the second forward scanning L in the direction L is ended.

After the end of the first backward scanning R, the recording paper 24 is further sent by only distance W/4 (corresponding to distance 3S) in the sub-scanning direction Y before the second forward scanning L is started. Then, the first to fourth nozzle units 42Y, 44M, 46C, and 48BK are main-scanned in the direction L. Thereby, cyan ink jetted from the second to fifth nozzle portions H2, H3, H4, and H5 is dot-printed (white ○ mark) as interlacing the preceding cyan dots formed in the above processes (a) and (b). At the same time, cyan ink jetted from the first nozzle portion H1 is dot-printed (white ○ mark)(FIG. 7(*c*)).

FIG. 6(*d*) and FIG. 7(*d*) show a state in which the second backward scanning in the direction R is ended.

After the end of the second forward scanning L, the recording paper 24 is further sent by only distance W/4 (corresponding to distance 3S) in the sub-scanning direction Y before the second backward scanning R is started. Then, the first to fourth nozzle units 42Y, 44M, 46C, and 48BK are main-scanned in the direction R.

Thereby, cyan ink jetted from the second to sixth nozzle portions H2, H3, H4, H5 and H6 is dot-printed (white ○ mark) as interlacing the preceding cyan dots formed in the above processes (a) to (c). At the same time, cyan ink jetted from the first nozzle portion H1 is dot-printed (white ○ mark)(FIG. 7(*d*)).

By providing the above four scanning processes (a), (b), (c) and (d), cyan ink is dot-printed onto the top end portion of the recording paper 24 to interlace the space between the preceding cyan dots. As a result, cyan ink is dot-printed onto the top end portion of the recording paper 24 with a predetermined dot density.

In other words, the pitch of the scanning boundaries of each time becomes W/4, with the result that the scanning width W is subdivided. For this reason, the stripped patterns can be largely reduced. Moreover, even if the jet patterns are formed on the first to sixth nozzle portions H1 to H6, generation of the stripped patterns can be prevented since the positions of the jet patterns are dispersed to four places of the scanning width W.

As explained above, the above processes are repeated so as to carry the recording paper 24, so that ink jetted from the respective nozzle units 42Y, 44M, 46C and 48BK is color-superimposed and dot-printed on the recording paper 24 in order.

The order of forming the dot-print is not limited to the above-explained structure of the embodiment, and various modifications can be made. Moreover, it is possible to provide the print in which the head structure of this embodiment is used, the print mode of FIG. 4 is used, and the dot pitch is doubled.

Figure 8:
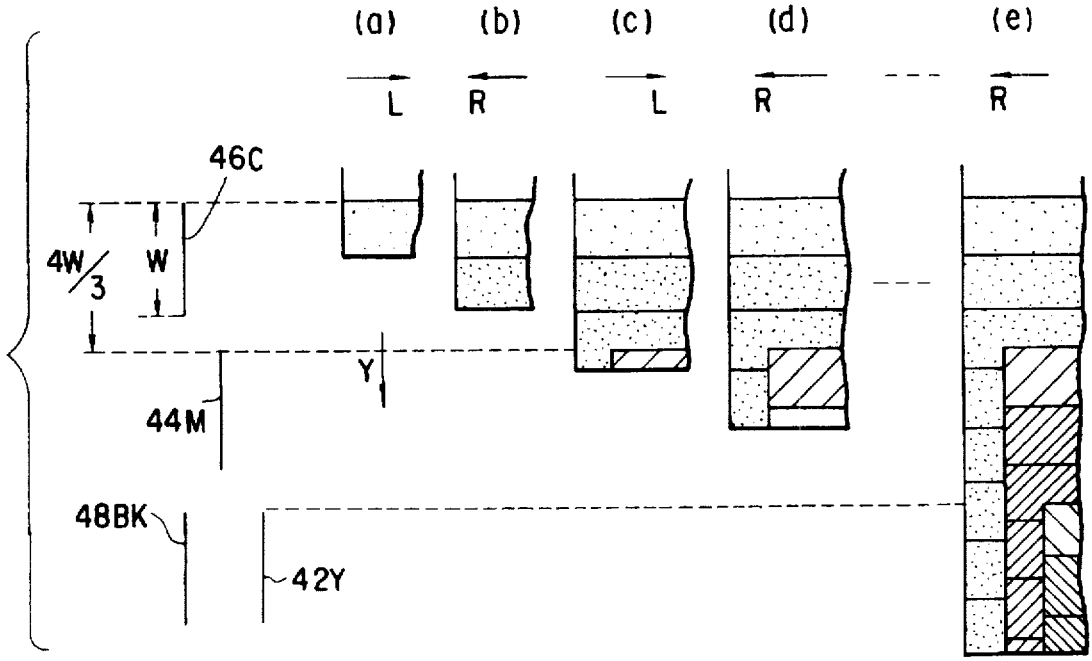
FIG. 8 is a view explaining an operation of an ink jet printer of a sixth embodiment of the present invention.

The following will explain an ink jet printer of a sixth embodiment of the present invention with reference to FIG. 8. In the explanation of this embodiment, the same reference numerals are added to the structure common to the fifth embodiment, and the explanation is omitted.

The ink jet printer of this embodiment relates to improvement of the fifth embodiment, and aims to reduce printing time.

More specifically, in this embodiment, the recording paper 24 is sent by W/2 in the sub-scanning direction Y in each of the main scanning directions (R, L). In this embodiment, the array pitch P is defined to 4W/3 since three colors, cyan, magenta, and yellow are the number of basic color ink. It is noted that printing is performed with a predetermined dot density in the main scanning direction at the time of the forward scanning and the backward scanning.

According to this embodiment, in the dot-print operation, the amount of which the recording paper 24 is sent is W/2 in the sub-scanning direction Y in each of the main scanning directions (R, L), and printing can be performed with a predetermined dot density in the main scanning direction at the time of the forward scanning and the backward scanning.

Therefore, by providing processes (a) to (e) of FIG. 8, basic color ink of cyan (sand portion), magenta (right upward portion), and yellow (right downward portion) is color-superimposed and dot-printed on the recording paper 24 in order.

Regarding the above-formed print image, the stripped boundaries of each ink are dispersed to two portions of the scanning width W, and the boundaries are shifted each other. Due to this, the stripped patterns of the boundaries can be prevented from being emphasized. Moreover, the order of the color superimposition of ink is cyan, magenta, and yellow, and the order is the same at the arbitrary portion of the recording paper 24. Due to this, the stripped patterns can be completely removed. Furthermore, since printing can be performed with a predetermined dot density by one forward and backward scanning, reduction of printing time can be achieved.

By the way, the ink jet printers explained in the fifth and sixth embodiments (FIGS. 6 to 8) have the structure, which is favorable for realizing the apparatus in which the high density print mode and the low density print mode can be selected.

For example, for carrying out the high density recording of print mode 800 DPI by use of the multi-nozzle ink jet print heads having a plurality of nozzle portions (marks H1 to H6 of FIG. 7, and 52 of (f) of FIG. 4) and arranged in the sub-scanning direction with a pitch of 0.0635 millimeter in order to carry out printing of standard 400 DPI, the print control may be carried out based on the print mode used in the fifth and sixth embodiments. On the other hand, for carrying out the low density recording of print mode 400 DPI, the print control may be carried out by the structure similar to the fifth and sixth embodiments as shown in FIG. 2.

More specifically, there may be provided means for setting the array pitch P of the respective nozzle portions of each print head to W {1+(1/N')} and for selecting the low density recording mode and the high density recording mode, and a circuit for controlling the print head driver in accordance with the selected mode by the above means so as to scan each print head.

The following will explain an ink jet printer of a seventh embodiment of the present invention with reference to FIGS. 9A to 11. In the explanation of this embodiment, the same reference numerals are added to the structure common to the structure of FIGS. 1A, 1B, and 1C, and the explanation is omitted.

The ink jet printer of this embodiment is structured such that ink jetted at the time of the forward scanning and the backward scanning is dripped to a target dripping position drop by drop.

By the way, if the dripping position of the ink is changed, the dripping dot positions, which are formed on the recording paper 24 at the time of the forward scanning and the backward scanning, are shifted.

It is assumed that ink is jetted at a jet velocity $v_1$ from the multi-nozzle ink jet print heads, which are moved in the main scanning direction at a moving velocity $v_2$. In this case, if a gap between the print heads and recording paper 24 is G, and arrival time till ink arrives at the recording paper 24 is t, the following equation is established.

$$G=V_1t$$

In this case, if the target dripping position on the recording paper 24 is Q, ink, which is jetted to the target tripping position at the jet velocity $v_1$, is dripped to a position J, which is shifted by $v_2t$ in the main scanning direction during the time till ink is dripped since the print heads are moved at the moving velocity $v_2$.

More specifically, in a case where the jet velocity $v_1$ of ink is 5 m/s, gap G is 1 mm, the print dot density is 400 DPI, and the driving speed of the print head is 5 kHz, the moving velocity $v_2$ is 317.5 mm/s and arrival time t is 0.0002 sec. Therefore, $v_2t$=0.0635 mm, which is the amount of shift corresponding to about one dot of print dot density of 400 DPI.

Figure 9A:
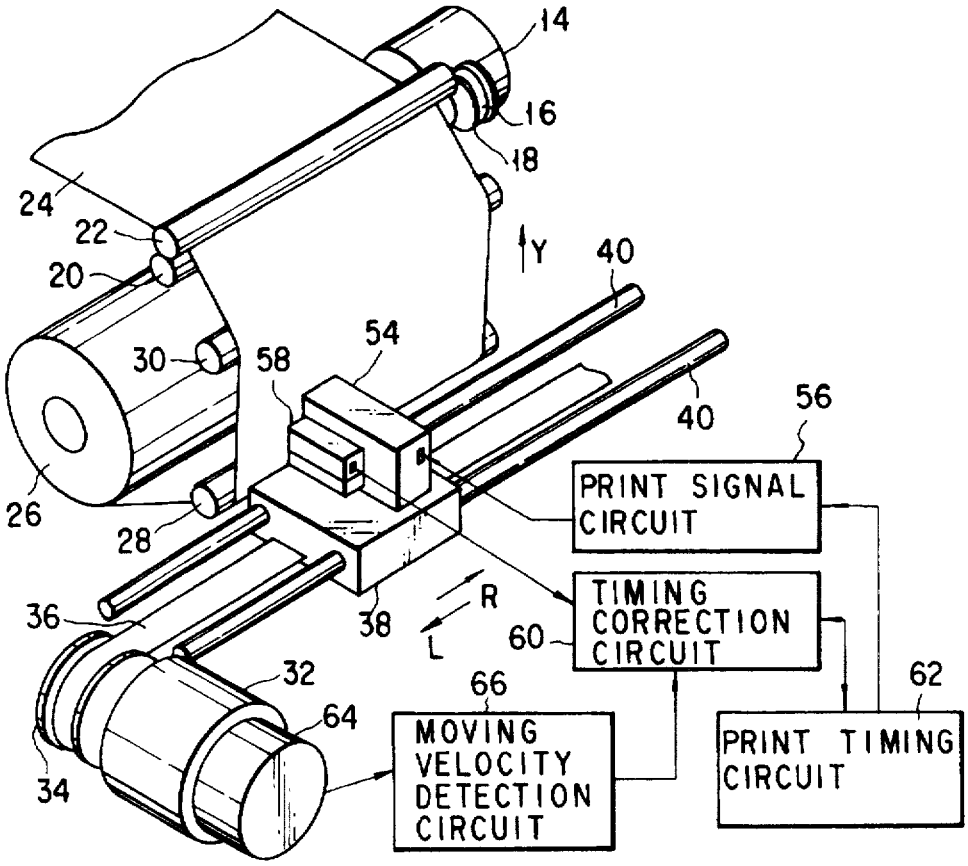
FIG. 9A is a perspective view schematically showing the structure of an ink jet printer of a seventh embodiment of the present invention.
Figure 9B:
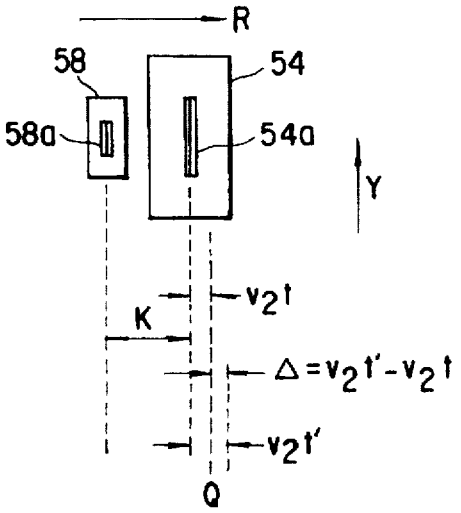
FIG. 9B is a view showing a positional relationship between an marking sensor and the multi-nozzle array ink jet print heads.
Figure 9C:
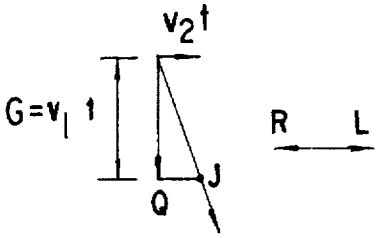
FIGS. 9C, 9D, 9E and 9F are views showing a state in which dripping dot positions are shifted at the time of the forward scanning and the backward scanning when the dripping position of the ink is changed.
Figure 9D:
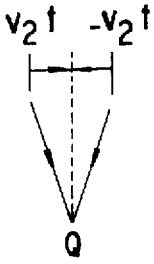

As shown in FIG. 9D, the print head is driven in consideration of the amount of shift $v_2t$, so that ink can be dripped to the target dripping position Q.

For example, in a case where the print head is moved in the forward scanning direction L, ink may be jetted at the position, which is before the target dripping position Q by $v_2t$. On the other hand, in a case where the print head is moved in the backward scanning direction R, ink may be jetted at the position, which is before the target dripping position Q by $-v_2t$.

Figure 9E:
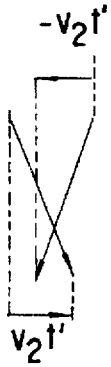

In the ink jet printer whose jet timing is adjusted, if the gap G is expanded for some reason, arrival time of ink is increased to t' (t<t') as shown in FIG. 9E. As a result, the amount of shift of the dripping position is also increased to $v_2t'$. The amount of shift $v_2t'$ acts on the direction where the shift of the dripping position at the time of the forward scanning and the backward scanning is relatively expanded. Due to this, irregularity of the dripping position occurs as shown by the top end positions of arrows in the figures.

Figure 9F:
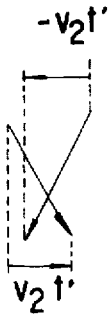

FIG. 9F shows a case in which jet velocity $v_1$ of ink is delayed by the variation of the drive voltage of the print head and that of ink viscosity.

If jet velocity $v_1$ of ink is delayed, arrival time of ink is increased to t' (t<t'). As a result, the amount of shift $v_2t'$ of the dripping position at the time of the forward scanning and the amount of shift $-v_2t'$ of the dripping position at the time of the backward scanning are increased. These amounts of shift act on the direction where the ink print positions are made irregular each other.

Regarding the shift of the dripping position, which is caused based on the time difference in delay time, which is from the time when ink is jetted till the time when ink is dripped, the shift of the dripping position is the problem, which cannot be corrected by the adjustment at the time of manufacturing the printer. Moreover, if the gap G is largely set, the above problem tends to be enlarged.

In order to solve the above problem, the ink jet printer of this embodiment comprises a multi-nozzle array ink jet print head 54 having a nozzle portion 54*a* as shown in FIGS. 9A and 9B. The nozzle portion 54*a* is provided in the sub-scanning direction Y, which is the direction where recording paper 24 is sent, and the multi-nozzle array ink jet print head 54 can be scanned forward and backward in the main scanning directions (R, L). In this case, predetermined ink is jetted from the nozzle portion 54*a* to the recording paper 24 sent in the sub-scanning direction every time when the forward scanning and the backward scanning are performed. Thereby, a stripped scanning print area, which corresponds to the scanning width of the sub-scanning direction Y of the nozzle portion 54*a*, can be formed on the recording paper 24.

Moreover, the ink jet printer of this embodiment comprises a print signal circuit 56, a marking sensor 58, a timing correction circuit 60, and a print timing circuit 62. The print signal circuit 56 can output a predetermined making signal to the multi-nozzle array ink jet print head 54 such that a predetermined marking is printed on the recording paper 24 through the nozzle portion 54*a* of the multi-nozzle array ink jet print head 54. The marking sensor 58 is structured to be movable in the main scanning directions (R, L) together with the multi-nozzle array ink jet print head 54. Moreover, the marking sensor 58 detects the marking printed on the recording paper 24, and outputs a detection signal. The timing correction circuit 60 calculates an amount of correction of ink jet timing based on the detection signal outputted from the marking sensor 58 and the moving velocity $v_2$ of the multi-nozzle array ink jet print head 54. The print timing circuit 62 controls the print signal circuit 56 based on the amount of correction calculated by the timing correction circuit 60 so as to control the ink jet timing jetted from the nozzle portion 54*a* of the multi-nozzle array ink jet print head 54.

In this embodiment, the moving velocity $v_2$ is detected by a moving velocity detection circuit 66, which is connected to a rotary encoder 64 for detecting a driving velocity of the main scanning motor 32. It is noted that the moving velocity may be detected based on a value, which is determined by a driving pulse period of a pulse motor.

The print signal circuit 56 transmits a print image signal to a driver circuit (not shown), which is built in the multi-nozzle array ink jet print head 54. Then, a stripped scanning print area, which corresponds to the scanning width of the sub-scanning direction Y of the nozzle portion 54*a*, is formed on the recording paper 24. Moreover, a marking signal for printing a marking M (FIG. 10A, 10B, and FIG. 11) extended along the sub-scanning direction Y, can be outputted.

The marking sensor 58 is provided on the carriage 38 and is adjacent to the multi-nozzle array ink jet print head 54. Also, the marking sensor 58 comprises a sensor section 58*a*, which can detect the marking printed on the recording paper 24.

The timing correction circuit 60 is structured to calculate the amount of correction of ink jet timing jetted from the nozzle portion 54*a* based on data of at least either an output timing of the marking signal or a marking position and data of at least either a detection timing of which the marking sensor 58 detects the marking M or a detection position.

It is noted that the other structure is the same as the ink jet printer of FIG. 1A, and the explanation is omitted.

According to the above-mentioned structure, the making sensor 58 continues to detect the marking M printed on the recording paper 24 by the multi-nozzle array ink jet print head 54, and the detected signal is outputted to the timing correction circuit 60. At the same time, moving velocity $v_2$ of the multi-nozzle array ink jet print head 54 is inputted to the timing correction circuit 60 from a moving velocity detection circuit 66. Moreover, a marking signal output timing data is inputted to the timing correction circuit 60 from a print timing circuit 62.

The timing correction circuit 60 calculates an amount of ink dripping position based on the detection signal, the moving velocity $v_2$, and marking signal output timing data. Then, if the amount of shift is different from a set value, the timing correction circuit 60 calculates an amount of correction for correcting the ink dripping position, and outputs calculation data to the print timing circuit 62.

The print timing circuit 62 controls the print signal circuit based on inputted calculation data, so that jet timing of ink jetted from the nozzle portion 54*a* of the multi-nozzle array ink jet print head 54 is controlled.

The following will explain the process of calculating the above amount of correction with reference to FIG. 9B.

In a state that the main scanning is performed in the direction R, the marking sensor 58 is provided at an upper stream side of the direction R, and a distance between the nozzle portion 54*a* and the sensor section 58*a* is defined to K.

In the above state, if the multi-nozzle array ink jet print head 54 is operated so as to form the marking M, marking lines or marking dots are shifted to the downstream side by $v_2t$ from a driving (or operating) position. As a result, a moving distance, which is from the time when the multi-nozzle array ink jet print head 54 is operated till the marking sensor 58 detects the marking M, becomes $K+V_2t$.

However, if arrival time t to the dripping is changed by some reason, the dripping position is shifted to the downstream by $v_2t'$ from a predetermined position. As a result, the moving distance becomes $K+v_2t'$.

Since the carriage 38 is operated at moving velocity $v_2$, the marking sensor 58 detects the marking M after passing time $(K+v_2t)/v_2$ from the time when the multi-nozzle array ink jet print head 54 is operated.

However, actually, since the arrival time t is changed, the marking sensor 58 detects the marking M after passing time $(K+v_2t')/v_2$.

In this case, since the time difference is t'−t, the amount of shift Δ becomes $V_2(t'-t)$.

In order to drip ink onto the target dripping position (for example, position Q of FIG. 9B) based on the above measured result, the operation timing of the multi-nozzle array ink jet print head 54 may be made faster by time difference t'−t. Or, a predetermined correction signal may be outputted from the timing correction circuit 60 to change a read address position of the print image signal to the coordinates of the upstream side by the amount of shift $v_2$ (t'−t). It is noted that the change of the timing change and that of the address position are substantially the same correction.

Figure 10A:
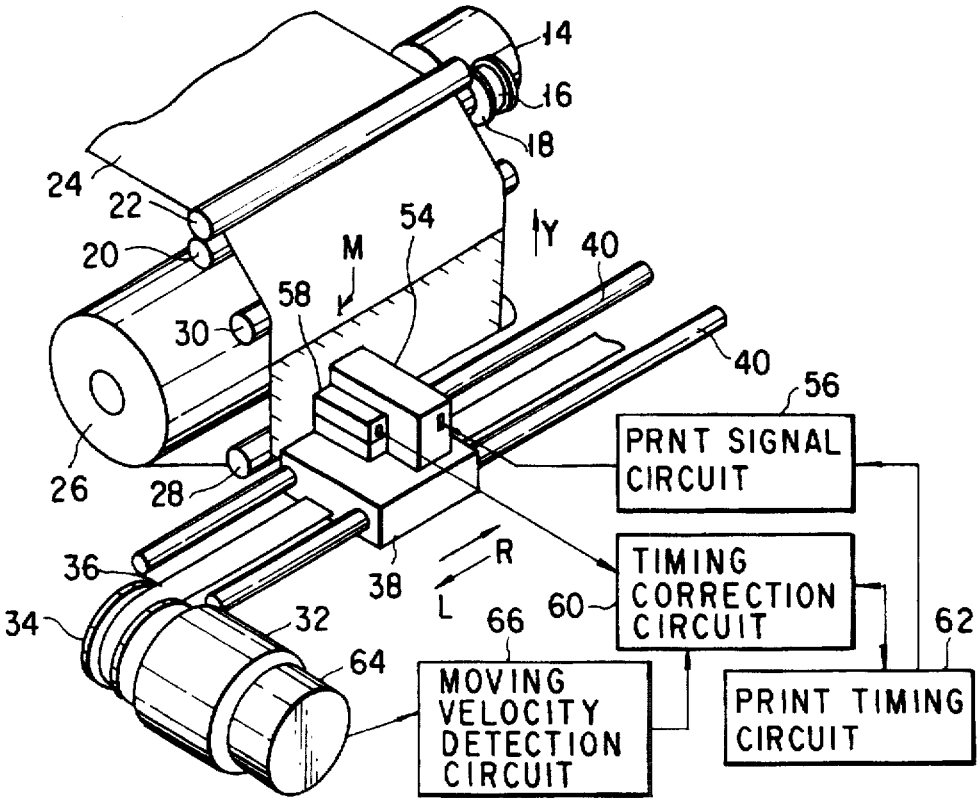
FIG. 10A is a perspective view showing a state in which a marking is printed in an effective print area of recording paper or a head position of an image area.

FIG. 10A shows a state in which the marking M is printed at the effective print area of the recording paper 24 or the head position of the image area (area surrounded by slant lines in the figure).

The markings M are printed when power of the apparatus is turned on or before writing each print image.

In a case where the recording paper 24 is roll paper, the area of the marking M can be cut away as a head reader section.

Figure 10B:
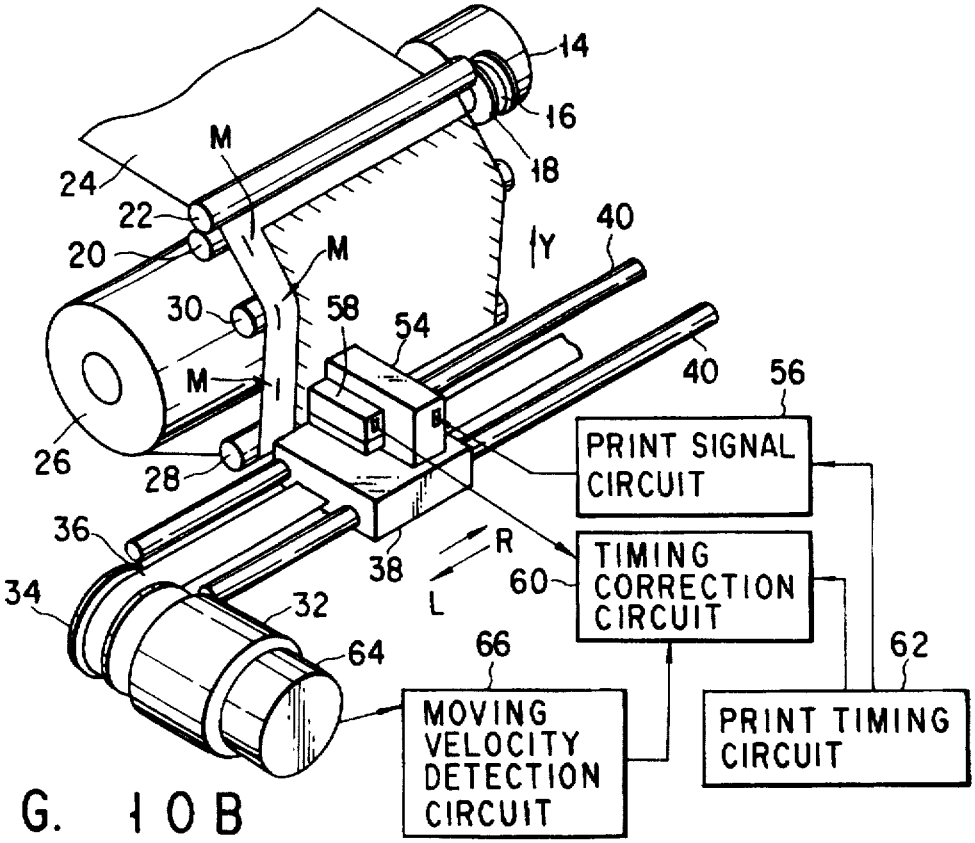
FIG. 10B is a perspective view showing a state in which a marking is printed in an effective print area of recording paper or an end portion of a width direction of an image area by a predetermined period.

FIG. 10B shows a state in which the markings M are printed at the effective print area of the recording paper 24 or a wide direction end portion of the image area (area surrounded by slant lines in the figure) at a predetermined period.

These markings M are printed by outputting the marking signal at a fixed period from the print signal circuit 56 while the recording paper 24 is moved in the sub-scanning direction Y.

By printing the markings M as motioned above, the correction of the ink dripping position can be performed at the fixed period during the printing operation. In other words, even if viscosity of ink is changed in accordance with the change of temperature of the multi-nozzle array ink jet print head 54 so that the dripping position is shifted, the timing correction circuit 60 calculates the amount of correction of jet timing of ink jetted from the nozzle portion 54*a* so as to renew the amount based on the detection signal outputted from the marking sensor 58, which has detected the marking M printed at the fixed period.

Figure 11:
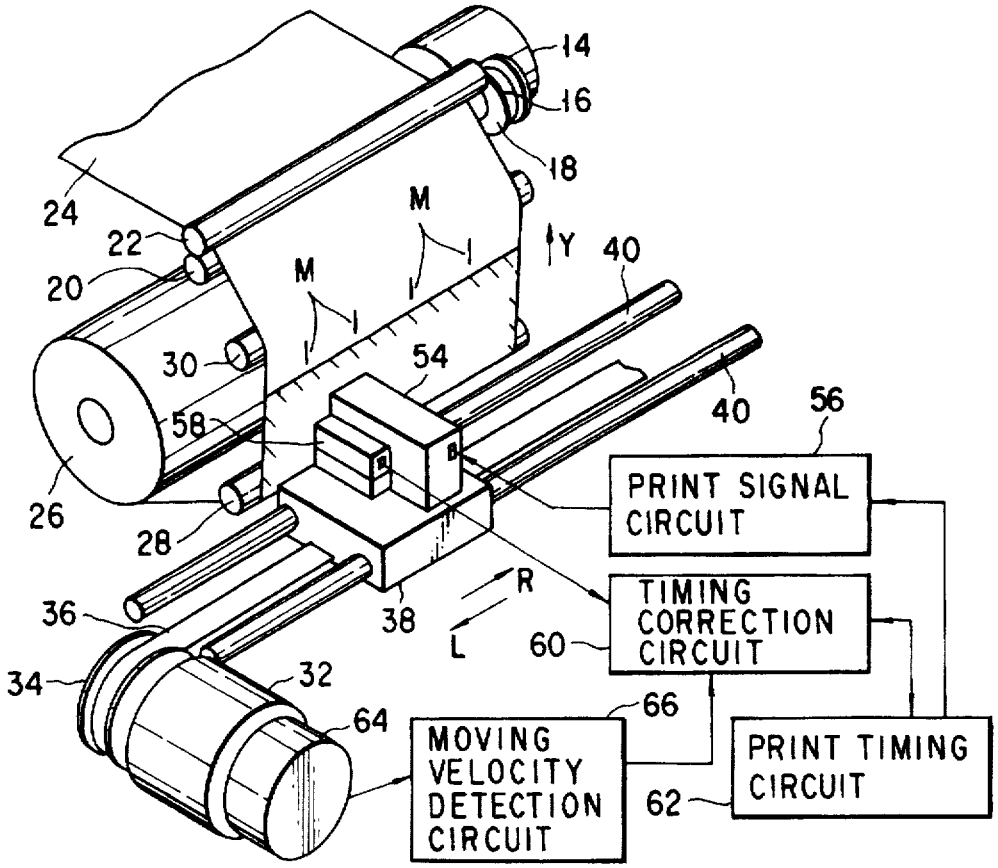
FIG. 11 a perspective view showing a state in which a marking is printed in an effective print area of recording paper or a head position of an image area by a predetermined pitch.

FIG. 11 shows a state in which the markings M are printed at the effective print area of the recording paper 24 or the head position of the image area (area surrounded by slant lines in the figure) at a predetermined pitch.

These markings M are printed by outputting the marking signal at a fixed period from the print signal circuit 56 while the multi-nozzle array ink jet print head 54 is moved in the main scanning directions (R, L).

In the case where the above marking M are provided, the timing correction circuit 60 calculates the amount of correction of jet timing of ink jetted from the nozzle portion 54*a* based on an average value of the time difference between the marking detection timing of the marking sensor 58 and the output timing of the marking signal.

The shift of the ink dripping position is varied in accordance with the change of the gap G (FIG. 9C). Due to this, the correction value is calculated as detecting the plurality of markings M printed in the main scanning directions (R, L)

as shown in FIG. 11, thereby a correction processing can be carried out accurately as compared with the case of using the marking M of one portion.

Figure 12A:
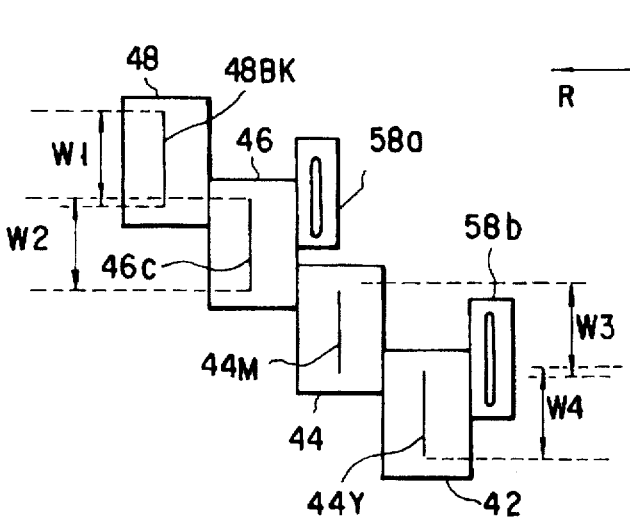
FIG. 12A is an enlarged view schematically showing the structure of an ink jet printer of an eighth embodiment of the present invention.
Figure 12B:
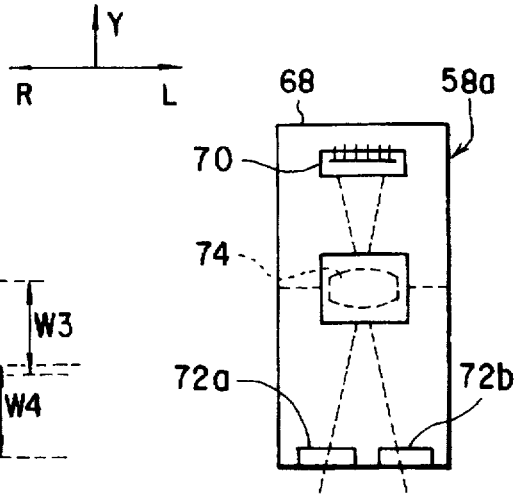
FIG. 12B is a plane view schematically showing the structure of the marking sensor.

The following will explain an ink jet printer of an eighth embodiment of the present invention with reference to FIGS. 12A and 12B. In the explanation of this embodiment, the same reference numerals are added to the structure common to the structure of FIGS. 1A to 1C and FIGS. 9A to 11, and the explanation is omitted.

The ink jet printer of this embodiment is the color ink jet printer in which the first to fourth multi-nozzle array ink jet print heads 42, 44, 46, ad 48 are used as shown in FIG. 1B. In order to detect the two markings M (FIG. 10B and FIG. 11) formed on the recording paper 24 through the first to fourth nozzle units 42Y, 44M, 46C, and 48BK, first and second marking sensors 58*a* and 58*b* are provided.

More specifically, as shown in FIG. 12A, the first marking sensor 58*a* is attached to an upper side surface of the third multi-nozzle ink jet print head 46 to partially cross the marking area (corresponding to the scanning widths W2 and W1 of the third and fourth nozzle units 46C and 48BK), which is formed on the recording paper 24 by the third and fourth nozzle units 46C and 48BK. On the other hand, the second marking sensor 58*b* is attached to an upper side surface of the first multi-nozzle array ink jet print head 42 to partially partially cross the marking area (corresponding to the scanning widths W4 and W3 of the first and second nozzle units 42Y and 44M), which is formed on the recording paper 24 by the first and second nozzle units 42Y and 44M.

These first and second marking sensors 58*a* and 58*b* are structured such that a detection signal for correcting jet timing of each of ink jetted from the first to fourth nozzle units 42Y, 44M, 46C, and 48BK can be outputted.

FIG. 12B shows the internal structure of the first and second marking sensors 58*a* and 58*b*. However, since the internal structure of these sensors 58*a* and 58*b* are the same as each other, only the internal structure of the first marking sensors 58*a* is shown in FIG. 12B.

The first marking sensor 58*a* comprises a sensor housing 68. In the sensor housing 68, there are provided a CCD linear image sensor array 70, a light source (not shown), first and second color characteristic filters 72*a* and 72*b*, and a projection lens 74. The CCD linear image sensor array 70 is formed in the main scanning directions (R, L). The light source emits light to two markings M formed on the recording paper 24 (these markings are markings M of black ink and cyan ink formed on the recording paper 24 through the third and fourth nozzle units 46*c* and 48BK. The first and second color characteristic filters 72*a* an 72*b* absorb marking reflected light reflected from the markings M illuminated by the light source. The projection lens 74 projects the reflected light, which is transmitted through the first and second color characteristic filters 72*a* and 72*b*, in the direction of the CCD linear image sensor array 70.

The above light source is provided outside of a light path of the projection lens 74. Red, green, and blue filters, which correspond to complementary colors of cyan, magenta, yellow ink, are preferably used as the first and second color characteristic filters 72*a* and 72.

In the case of using the above-mentioned filters, the marking reflected light, which is reflected from the markings M of the black ink and cyan ink, is absorbed and cut by the first and second color characteristic filters 72*a*, and 72*b*. Due to this, only reflected light, which is reflected from a white area of the recording paper 24 where no marking is printed, is arrived at the CCD linear image sensor array 70. In other words, when the first marking sensor 58*a* scans the marking position of, e.g., cyan ink, the marking reflected light, which is reflected from the marking M of cyan ink, is absorbed and cut by the first and second color characteristic filters 72*a* and 72*b*. Sequentially, when the first marking sensor 58*a* scans the marking position of, e.g., black ink, the marking reflected light, which is reflected from the marking M of black ink, is absorbed and cut by the first and second color characteristic filters 72*a* and 72*b*. Therefore, the first and second color characteristic filters 72*a* and 72*b* of this embodiment can surely absorb and cut only the marking reflected light, which is reflected from the marking M corresponding to the scanning position.

According to the above-explained structure, since two markings M can be detected by one marking sensor 58*a*, the number of parts of the apparatus can be reduced. Moreover, by providing the first and second color characteristic filters 72*a* and 72*b*, the sharp detection signal having good contrast can be obtained, so that the detection signal with high accuracy can be obtained.

The above-explained structure can be applied to the second marking sensor 58*b*. Moreover, the first and second color characteristic filters 72*a* and 72*b* are arranged in the sensor housing 68 close to the recording paper 24 in order to clearly separate the detection area. However, the filters 72*a* and 72*b* may be arranged in the optical path between the projection lens 74 and the CCD linear image sensor array 70.

Figure 13:
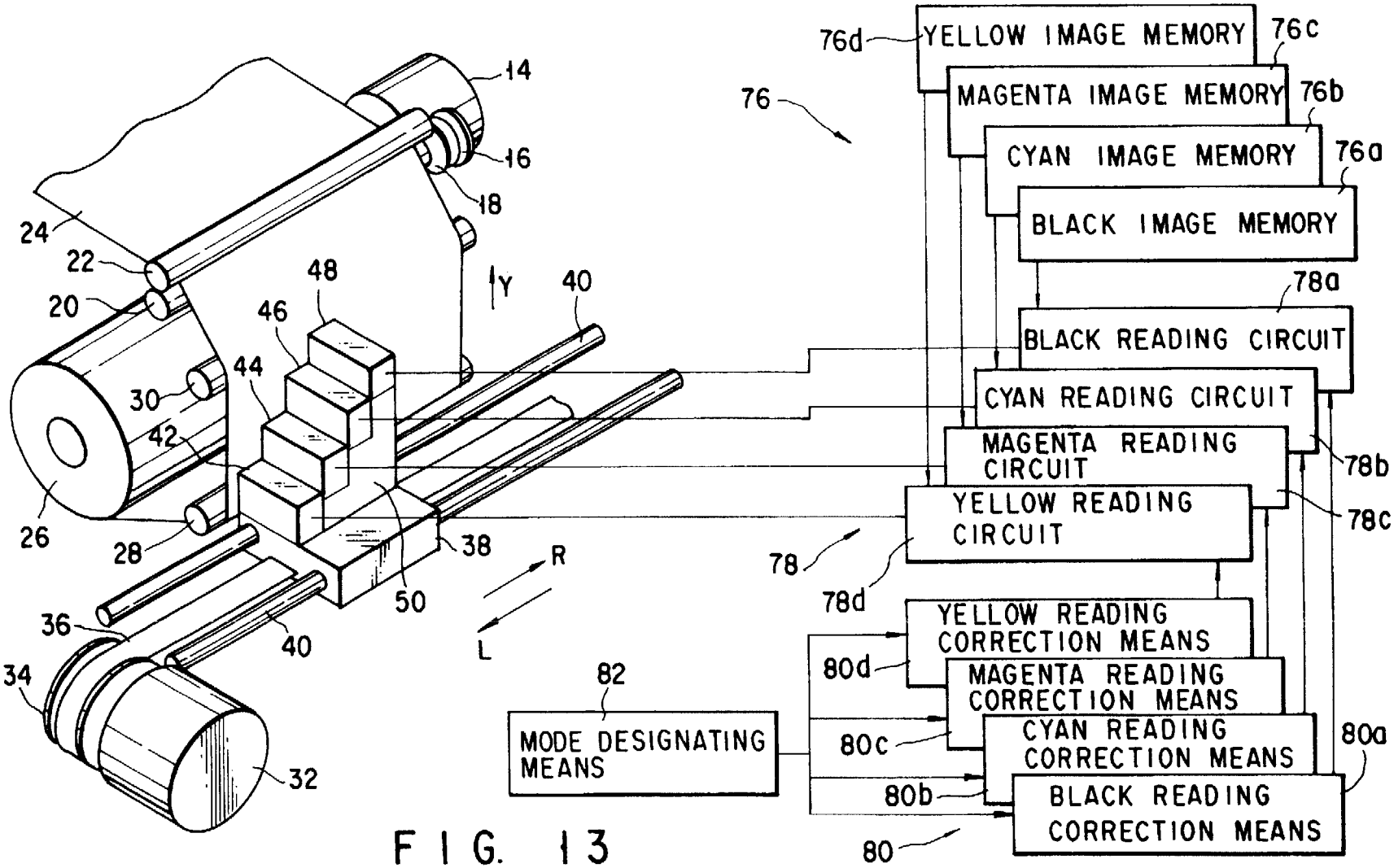
FIG. 13 is a perspective view schematically showing the structure of an ink jet printer of a ninth embodiment of the present invention.
Figure 14:
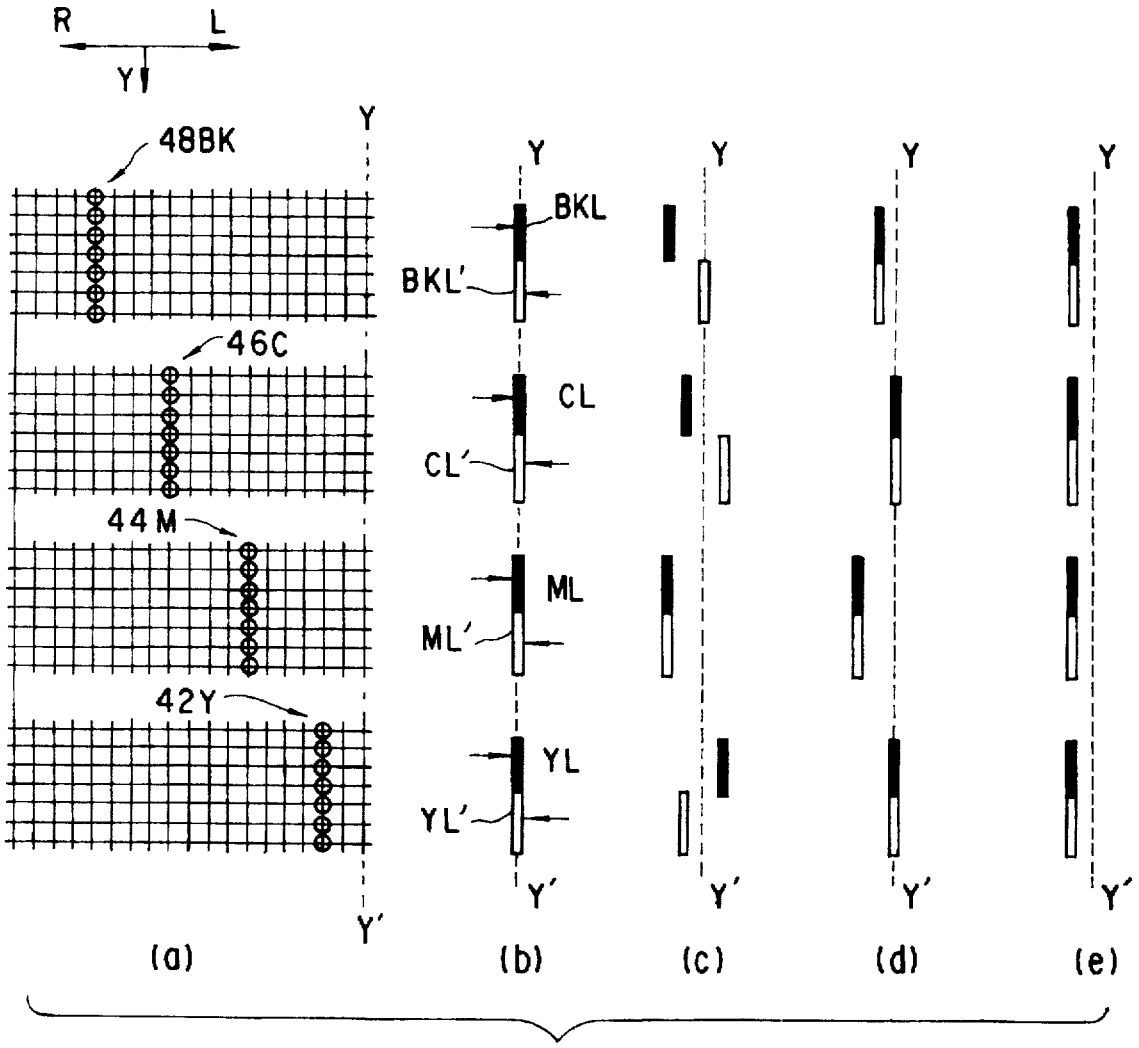
FIG. 14 is a view explaining an operation of a ninth embodiment of the present invention.
Figure 15A:
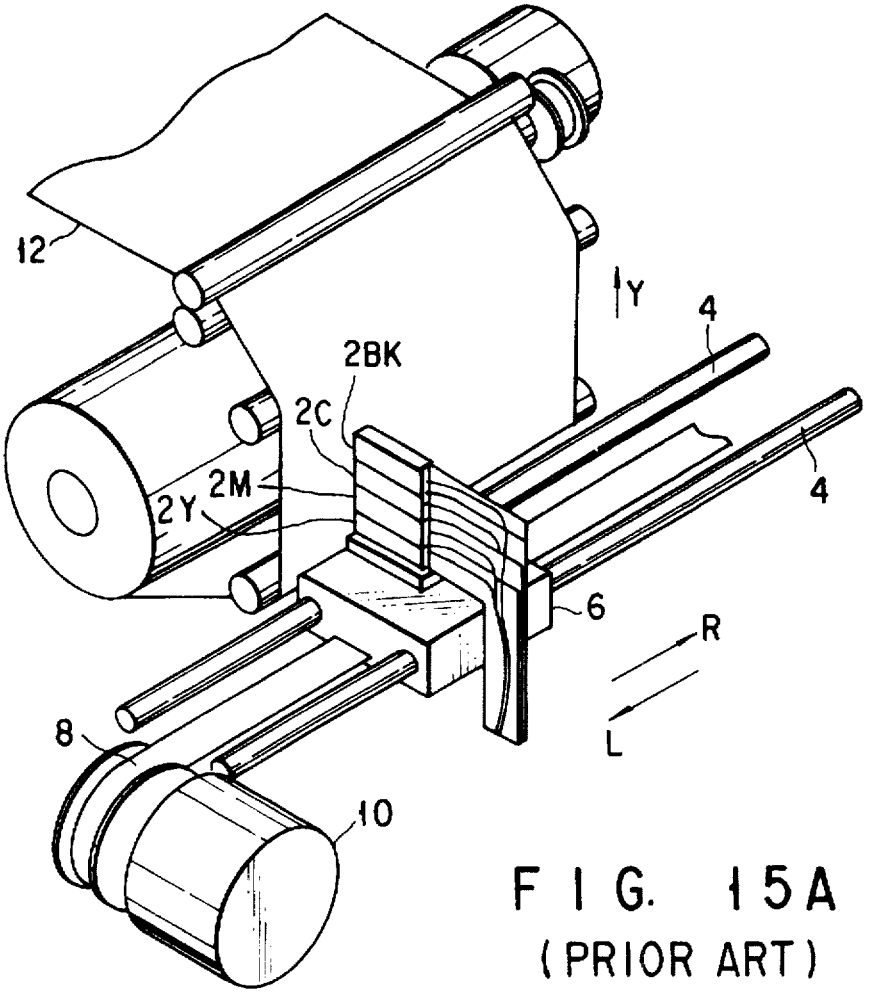
FIG. 15A (PRIOR ART)
FIG. 15A is a perspective view showing the structure of an image recording apparatus of prior art 1.
Figure 15B:
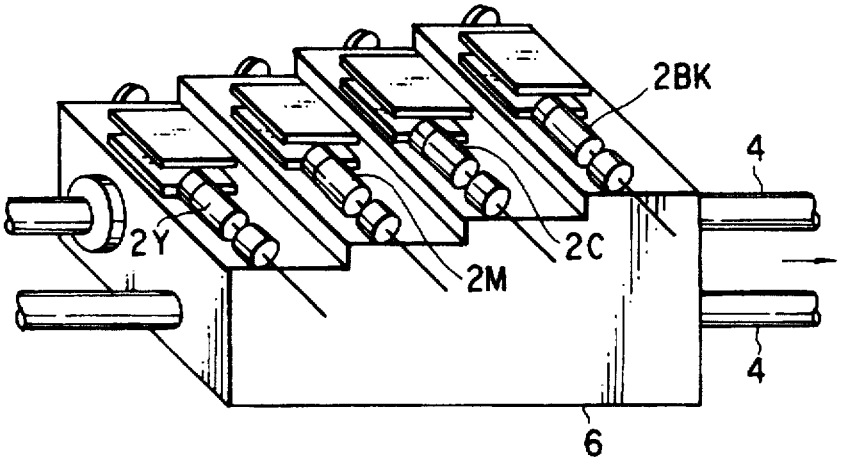
FIG. 15B (PRIOR ART)
FIG. 15B is a perspective view showing the structure of a charge-controlling type color ink jet printer of prior art 2.

The following will explain an ink jet printer of a ninth embodiment of the present invention with reference to FIGS. 13 and 14. In the explanation of this embodiment, the same reference numerals are added to the structure common to the structure of FIGS. 1A to 1C, and the explanation is omitted.

Normally, in adjusting the dripping position of each ink at the time of printing, it is extremely difficult to drip each ink onto the target dripping position even if the ink jet timing is irregularly corrected.

The ink jet printer of this embodiment aims to prevent the shift of the ink dripping position, which is caused by an error of the attaching positions of the first to fourth multi-nozzle array ink jet print heads 42, 44, 46, and 48.

More specifically, as shown in FIG. 13, the ink jet printer of this embodiment comprises a memory section 76, a reading circuit section 78, and a reading correction circuit section 80. The memory section 76 expands image data on a memory space to be stored. The reading circuit section 78 reads image data from the memory section 76 based on a predetermined address position on the memory space and address timing to be transferred to a driver circuit (not shown) of each of the first to fourth multi-nozzle array ink jet print heads 42, 44, 46, and 48. The reading circuit section 80 controls the reading circuit section 78 to correct the address position order and the address timing.

The memory section 76 comprises a black image memory 76*a*, a cyan image memory 76*b*, a magenta image memory 76*c*, and a yellow image memory 76*d* such that each image data, which is printed on the recording paper 24 through the first to fourth nozzle units 42Y, 44M, 46C, and 48BK, is expanded on the memory space to be stored.

The reading circuit section 78 comprises a black reading circuit 78*a*, a cyan reading circuit 78*b*, a magenta reading circuit 78*c*, and a yellow reading circuit 78*d* such that each image data is read from the memory section 76 based on the predetermined address position on the memory space and address timing to be transferred to the driver circuit (not shown) of each of the first to fourth multi-nozzle array ink jet print heads 42, 44, 46, and 48 corresponding to these image data.

The reading correction section 80 comprises a black reading correcting means 80*a*, a cyan reading correcting means 80*b*, a magenta reading correcting means 80*c*, and a yellow reading correcting means 80*d* such that the address position order of image data read from the memory section 76 by the reading circuit section 78 and the address timing are corrected in order to obtain mutual alignment of the respective ink printed on the recording paper 24 by the first to fourth nozzle units 42Y, 44M, 46C, and 48BK.

The black reading correcting means 80*a*, the cyan reading correcting means 80*b*, the magenta reading correcting means 80*c*, and the yellow reading correcting means 80*d* are connected to mode designating means 82, respectively. Then, the change of two correction modes can be carried out by mode designating means 82.

More specifically, in a case where a first correction mode is selected, there can be obtain a mode in which the address position order and the address timing are simultaneously moved forward or backward by the same amount in the main scanning directions (R, L) at the time of the forward scanning and the backward scanning. In a case where a second correction mode is selected, there can be obtain a mode in which one of the address position order and the address timing is moved forward and the other is moved backward simultaneously by the same amount in the main scanning directions (R, L) at the time of the forward scanning and the backward scanning.

As explained above, the reading correction section 80 can be changed to two types of correction modes by mode designating means 82. The amount of correction is set every correction mode, so that the address position order of image data read by the reading section and the address timing are corrected.

It is noted that the amount of correction of each of the correction modes may be set by an input of a keyboard or a DIP (dual in-line package) switch.

An operation of this embodiment will be explained with reference to FIGS. 13 and 14.

In FIG. 14, (a) shows a positional relationship between the coordinates on the recording paper 24 and the the first to fourth nozzle units 42Y, 44M, 46C, and 48BK, and (b) shows a print-dot position formed on the recording paper 24 by each of the nozzle units 42Y, 44M, 46C, and 48BK. Moreover, in FIG. 14, (c) shows a print-dot position before the reading correction section 80 is actuated (that is, before correction), (d) shows the print-dot position corrected based on the first correction mode, and (e) shows the print-dot position corrected based on the second correction mode.

In FIG. 14(*a*), squares show coordinates of dot positions on a print screen, and coordinates corresponding to print-dot positions on a memory space where the print image signal is written. The first to fourth nozzle units 42Y, 44M, 46C, and 48BK each having a plurality of nozzles (shown by white circles) are arranged on predetermined coordinates.

In FIG. 14(*a*), each of the first to fourth nozzle units 42Y, 44M, 46C, and 48BK is arranged at the position relatively shifted in the main scanning directions (R, L) and the sub-scanning direction Y. However, these nozzle units may be lined up in the main scanning directions (R, L) or the sub-scanning direction.

In the explanation of the operation, it is assumed that the first to fourth nozzle units 42Y, 44M, 46C, and 48BK face to the recording paper 24.

As shown in FIG. 14(*b*), when the first to fourth nozzle units 42Y, 44M, 46C, and 48BK are moved in the forward scanning direction L and the first nozzle unit 42Y passes a line Y–Y' extended in the sub-scanning direction Y, image data (image data read from the yellow image memory 76*d* by the yellow read circuit 78*d* to be along line Y–Y'), which is read faster than the passing time by predetermined time, is transferred to the driver circuit of the first print head 42. As a result, yellow ink is dot-printed on the line Y–Y' by the first nozzle unit 42Y. At this time, the print dot position corresponds to a black portion YL of FIG. 14(*b*).

Thereafter, when the first to fourth nozzle units 42Y, 44M, 46C, and 48BK are moved in the forward scanning direction L and the second nozzle unit 44M passes a line Y–Y' extended in the sub-scanning direction Y, image data (image data read from the magenta image memory 78*c* by the yellow read circuit 78*c* to be along line Y–Y'), which is read faster than the passing time by predetermined time, is transferred to the driver circuit of the second print head 44. As a result, magenta ink is dot-printed on the line Y–Y' by the second nozzle unit 44M. At this time, the print dot position corresponds to a black portion ML of FIG. 14(*b*).

The above-mentioned operation is repeated, so that cyan ink (shown by CL) and black ink (shown by BKL) are dot-printed on the line Y–Y'.

Then, conversely, when the first to fourth nozzle units 42Y, 44M, 46C, and 48BK are moved in the backward scanning direction R, black ink (BKL'), cyan ink (CL'), magenta ink (ML'), and yellow ink (YL') are dot-printed on the line Y–Y' in order of scanning. In this case, the drive timing of the first to fourth multi-nozzle array ink jet print heads 42, 44, 46, and 48, that is, jet timing of ink, which is jetted from the first to fourth nozzle units 42Y, 44M, 46C, and 48BK, is adjusted to be faster by predetermined time than passing time when the first to fourth nozzle units 42Y, 44M, 46C and 48BK pass the line Y–Y'.

The following will explain a case in which the nozzle units are main-scanned the direction L as the other method for adjusting the jet timing.

In this case, yellow ink is jetted from the first nozzle unit 42Y at an imaginary point, which defines the line Y–Y', then, an amount of movement of the carriage 38 is detected by means for detecting amount of movement (for example, the moving velocity detection circuit 66 of FIGS. 9A, 10A, 10B, and 11). Then, each color ink may be jetted from the second to fourth nozzle units 44M, 46C, and 48BK, is adjusted to be faster by predetermined amount than timing when the second to fourth nozzle units 44M, 46C and 48BK pass the imaginary line.

In the actual apparatus, the first to fourth multi-nozzle array ink jet print heads 42, 44, 46, and 48 are provided to have an error to a reference setting value. Also, in the gap between the first to fourth nozzle units 42Y, 44M, 46C, 48BK and the recording paper 24, there is provided an error to an reference setting value. Furthermore, the jet velocity of each color ink is varied in accordance with a reference speed. Therefore, dripping position of each color ink is shifted from the target dripping position by influence of these errors.

FIG. 14(*c*) illustrates an example showing a state of the dot position of each color ink when printing is performed at the time of the forward scanning and the backward scanning.

The shift of the dot position is caused by the above two factors. Due to this, if each dot position is set to be positioned to the line Y–Y' by the simple timing adjustment, much time is needed to perform the adjustment. Moreover, it becomes difficult to perform the adjustment of a predetermined range.

In order to solve the above problems, this embodiment aims to simplify the adjustment of shift by selectively changing the first and second correction modes.

As mentioned above, the shift of the dot position caused in scanning forward and backward is generated when the gap is shifted from the reference setting value or the jet velocity of each ink is shifted from the reference velocity.

In order to correct such amounts of the shift, the first correction mode is selected. In this case, the dot position at the time of the forward scanning and the dot position at the time of the backward scanning are moved in the direction, which is opposite to the main scanning directions (R, L), in the coordinates on the recording paper 24 by providing a certain correction value. In other words, the shift of the dot position is generated in the relatively opposite direction along the main scanning directions (R, L) at the time of the forward scanning and the backward scanning. Due to this, in order to correct the above generated shift, the dot position may be shifted to the relatively opposite direction. In order to reflect such a correction on the address position order of image data and address timing, the address position order of image data and address timing may be simultaneously moved forward or backward by the same amount (amount corresponding to the amount of shift) in the scanning direction at the time of the forward scanning and the backward scanning.

FIG. 14(*d*) shows the result of the correction, which is made based on the first correction mode. The dot-print positions of the respective color ink are mutually shifted against the line Y–Y'. However, the dot-print positions (BKL and BKL', CL and CL', ML and ML', YL and YL') of the respective color ink, which are printed by the forward scanning, are mutually aligned in the sub-scanning direction Y.

The reason why such a print state is caused is that the attaching positions of the first to fourth multi-nozzle array ink print heads 42, 44, 46, and 48 are shifted against the reference setting value.

For example, if one of the forward scanning timing and the backward scanning timing is shifted in order to correct the above amount of shift, the dot positions at the time of the forward scanning and backward scanning are shifted. Therefore, as shown in FIG. 14(*d*), the second correction mode is selected so as to correct the amount of shift in the main scanning direction as maintaining the aligned dot positions.

In order to reflect the second correction mode on the address position order of image data and address timing, one of the address position order of image data and address timing may be moved forward by the same amount (amount corresponding to the amount of shift) in the main scanning directions (R, L) at the time of the forward scanning and the backward scanning. At the same time, the other may be moved backward.

FIG. 14(*e*) shows the result of the correction, which is made based on the first and second correction modes.

In this example, the correction of the dot position of black ink is not made, and the respective dot positions of cyan, magenta, and yellow are aligned at the dot positions of black ink.

As mentioned above, by the structure in the different correction modes can be selectively executed, the correction working can be largely simplified.

It is noted that the first correction mode can be executed by use of the timing correction circuit 60 of FIGS. 9A, 10A, 10B, and 11.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An ink jet printer comprising:

a plurality of multi-nozzle array ink jet print heads arranged in a sub-scanning direction in which recording paper is sent, said ink jet print heads being arranged for scanning forward and backward in a main scanning direction to record different color ink onto said recording paper, and each of said ink jet print heads having a nozzle unit including a plurality of nozzle portions;

wherein said plurality of nozzle portions are arranged to jet a predetermined ink to said recording paper sent in the sub-scanning direction every time the forward scanning and the backward scanning are performed so as to form a stripped scanning printed area on said recording paper corresponding to a scanning width in the sub-scanning direction of each of said nozzle units of said ink jet print heads;

wherein said ink jet print heads are structured to satisfy $W<P<2W$, where P is an array pitch of said ink jet print heads, and W is said scanning width in the sub-scanning direction of each of said nozzle units of said ink jet print heads; and wherein said array pitch P substantially satisfies $W(1+(1/N'))$, where N' corresponds to one of (i) a number of heads of basic color ink and (ii) a number of heads of all colors.

2. The ink jet printer according to claim 1, wherein:

said ink jet print heads comprise first, second, third and fourth ink jet print heads for recording yellow, magenta, cyan, and black ink onto said recording paper;

said first, second and third ink jet print heads record yellow, magenta, and cyan ink, respectively, and are arranged to have a pitch of 4W/3 along the sub-scanning direction; and said fourth ink jet print head records black ink, and is provided at an arbitrary position in said sub-scanning direction so as not to interfere with said first, second and third ink jet print heads.

3. The ink jet printer according to claim 1, wherein:

said ink jet print heads comprise first, second, third and fourth ink jet print heads for recording yellow, magenta, cyan, and black ink onto said recording paper; and said first, second, third and fourth ink jet print heads are arranged to have a pitch of 5W/4 along the sub-scanning direction.

4. An ink jet printer comprising:

a plurality of low density multi-nozzle array ink jet print heads arranged in a sub-scanning direction in which recording paper is sent, said ink jet print heads being arranged for scanning forward and backward in a main scanning direction to record different color ink onto said recording paper, and each of said ink jet print heads having a nozzle unit including a plurality of nozzle portions arranged to have a nozzle pitch twice as large as a predetermined print dot pitch of the ink jet printer;

wherein said plurality of nozzle portions are arranged to jet a predetermined ink to said recording paper sent in the sub-scanning direction every time the forward scanning and the backward scanning are performed so as to form interlacing stripped scanning printed areas on said recording paper corresponding to a scanning width in the sub-scanning direction of each of said nozzle units of said ink jet print heads;

wherein said ink jet print heads are structured to satisfy $W<P<2W$, where P is an array pitch of said ink jet print heads, and W is said scanning width in the sub-scanning direction of each of said nozzle units of said ink jet print heads; and wherein said array pitch P substantially satisfies $W(1+(1/N'))$, where N' corresponds to one of (i) a number of heads of basic color ink and (ii) a number of heads of all colors.

5. The ink jet printer according to claim 4, wherein:

said ink jet print heads are controlled to interlace with said stripped scanning printed areas every time the forward scanning and the backward scanning are performed in order to form said stripped scanning printed areas with the predetermined print dot pitch of the ink jet printer in the main scanning and the sub-scanning directions at the time of at least one of the forward and the backward scanning; and said recording paper is sent by substantially W/4 in the sub-scanning direction every time the forward scanning and the backward scanning are performed.

6. An ink jet printer comprising:

a plurality of low density multi-nozzle array ink jet print heads arranged in a sub-scanning direction in which recording paper is sent, said ink jet print heads being arranged for scanning forward and backward in a main scanning direction to record different color ink onto said recording paper, and each of said ink jet print heads having a nozzle unit including a plurality of nozzle portions arranged to have a nozzle pitch twice as large as a predetermined print dot pitch of the ink jet printer;

wherein said plurality of nozzle portions are arranged to jet a predetermined ink to said recording paper sent in the sub-scanning direction every time the forward scanning and the backward scanning are performed so as to form interlacing stripped scanning printed areas on said recording paper corresponding to a scanning width in the sub-scanning direction of each of said nozzle units of said ink jet print heads;

wherein said ink jet print heads are structured to satisfy $W<P<2W$, where P is an array pitch of said ink jet print heads, and W is said scanning width in the sub-scanning direction of each of said nozzle units of said ink jet print heads; and wherein said array pitch P substantially satisfies $W(1+(1/2N'))$, where N' corresponds to one of (i) a number of heads of basic color ink and (ii) a number of heads of all colors, and said recording paper is sent by substantially W/2 in the sub-scanning direction every time the forward scanning and the backward scanning are performed.

7. An ink jet printer comprising:

a plurality of low density multi-nozzle array ink jet print heads arranged in a sub-scanning direction in which recording paper is sent, said ink jet print heads being arranged for scanning forward and backward in a main scanning direction to record different color ink onto said recording paper, and each of said ink jet print heads having a nozzle unit including a plurality of nozzle portions arranged to have a nozzle pitch twice as large as a predetermined print dot pitch of the ink jet printer;

wherein said plurality of nozzle portions are arranged to jet a predetermined ink to said recording paper sent in the sub-scanning direction every time the forward scanning and the backward scanning are performed so as to form interlacing stripped scanning printed areas on said recording paper corresponding to a scanning width in the sub-scanning direction of each of said nozzle units of said ink jet print heads;

wherein said ink jet print heads are structured to satisfy $W<P<2W$, where P is an array pitch of said ink jet print heads, and W is said scanning width in the sub-scanning direction of each of said nozzle units of said ink jet print heads; and wherein said array pitch P substantially satisfies $W(1+(1/N'))$, where N' corresponds to one of (i) a number of heads of basic color ink and (ii) a number of heads of all colors, and said recording paper is sent by substantially W/2 in the sub-scanning direction every time the forward scanning and the backward scanning are performed.

* * * * *